US012286775B2

(12) United States Patent
Zhang et al.

(10) Patent No.: US 12,286,775 B2
(45) Date of Patent: Apr. 29, 2025

(54) WATER DISCHARGE STRUCTURE AND SENSOR-OPERATED WATER DISCHARGE DEVICE

(71) Applicant: Xiamen Forbetter Sanitary Ware Co., Ltd., Fujian (CN)

(72) Inventors: Xingui Zhang, Xiamen (CN); Yihui Chen, Xiamen (CN); Mouyong Lin, Xiamen (CN)

( * ) Notice: Subject to any disclaimer, the term of this patent is extended or adjusted under 35 U.S.C. 154(b) by 385 days.

(21) Appl. No.: 17/899,618

(22) Filed: Aug. 31, 2022

(65) Prior Publication Data

US 2024/0068214 A1 Feb. 29, 2024

(51) Int. Cl.
*E03C 1/05* (2006.01)
*E03C 1/04* (2006.01)

(52) U.S. Cl.
CPC ..... *E03C 1/057* (2013.01); *E03C 2001/0418* (2013.01); *Y10T 137/9464* (2015.04)

(58) Field of Classification Search
CPC ..... E03C 2001/0415; E03C 1/057; F16K 19/006; Y10T 137/9464
USPC ..... 137/801, 625.41
See application file for complete search history.

(56) References Cited

U.S. PATENT DOCUMENTS 5,095,934 A * 3/1992 Iqbal ..... F16K 27/045 137/636.2
6,019,130 A * 2/2000 Rump ..... E03C 1/057 137/601.01
7,650,653 B2 * 1/2010 Johnson ..... E03C 1/0401 251/367
9,212,473 B2 * 12/2015 Baker ..... E03C 1/04
9,963,859 B2 * 5/2018 Mainka ..... E03C 1/04
10,450,729 B2 * 10/2019 Chang ..... F16K 11/085
10,753,501 B2 * 8/2020 Hong ..... F16K 31/0603
11,215,289 B1 * 1/2022 Qiu ..... F16K 11/0787
11,505,928 B2 * 11/2022 Benstead ..... E03C 1/0403
11,655,620 B2 * 5/2023 Zhang ..... F16K 11/22 137/78.1
11,661,729 B2 * 5/2023 Sawaski ..... E03C 1/057 137/801
11,821,185 B2 * 11/2023 Zhang ..... E03C 1/057
2004/0187934 A1 * 9/2004 Hwang ..... E03C 1/05 137/601.14
2007/0044850 A1 * 3/2007 Pieters ..... F16K 11/0787 137/597

(Continued)

*Primary Examiner* — Daphne M Barry

(57) ABSTRACT

A water discharge structure and a sensor-operated water discharge device are disclosed. The water discharge structure includes a valve core seat having independent cold water, hot water and sensor-operated mixed water flow channels. An accommodating chamber is disposed inside the sensor-operated mixed water flow channel for accommodating a solenoid valve that controls opening and closing of the sensor-operated mixed water flow channel. The valve core seat has a cold water outlet, a hot water outlet, a sensor-operated mixed water inlet and a mechanically-operated mixed water inlet that are located on a same end face of the valve core seat. It is convenient to assemble the valve core seat and the valve core of the sensor-operated water discharge device. The overall assembly of the sensor-operated water discharge device can be realized when it leaves the factory, and the installation operation can be simplified for the user.

16 Claims, 20 Drawing Sheets

(56) References Cited

U.S. PATENT DOCUMENTS

| | | | | |
|---|---|---|---|---|
| 2009/0094740 | A1* | 4/2009 | Ji | E03C 1/057<br>137/624.11 |
| 2012/0248351 | A1* | 10/2012 | Huang | F16K 27/045<br>251/129.01 |
| 2015/0292187 | A1* | 10/2015 | Tseng | E03C 1/0412<br>4/677 |
| 2016/0215482 | A1* | 7/2016 | Fourman | E03C 1/0404 |
| 2020/0340221 | A1* | 10/2020 | Peng | E03C 1/04 |
| 2021/0325918 | A1* | 10/2021 | Ottelli | E03C 1/0412 |
| 2024/0076859 | A1* | 3/2024 | Yan | F16L 27/12 |
| 2024/0247469 | A1* | 7/2024 | Huang | E03C 1/057 |

* cited by examiner

WATER DISCHARGE STRUCTURE AND SENSOR-OPERATED WATER DISCHARGE DEVICE

BACKGROUND OF THE INVENTION

1. Field of the Invention

The present invention relates to a sensor-operated water discharge device, and more particularly to a water discharge structure and a sensor-operated water discharge device.

2. Description of the Prior Art

In general, a conventional sensor faucet includes a valve core and an infrared sensor. It is necessary to provide a mechanical switch to control the opening and closing of the main waterway for supplying water. The mechanical switch cooperates with a solenoid valve to form a control box, and is installed under the basin with water tubes and other components. The entire overall structure is relatively complex. Especially, when the installation space under the basin is limited, the installation is difficult. For a user without professional knowledge, it is difficult to install the sensor faucet by himself/herself, and the user experience is poor.

SUMMARY OF THE INVENTION

The primary object of the present invention is to provide a water discharge structure and a sensor-operated water discharge device, which can realize the overall assembly of the sensor-operated water discharge device when it leaves the factory and simplify the installation operation for the user.

In order to achieve the above-mentioned object, the present invention adopts the following solutions.

A water discharge structure comprises a valve core seat. A surface of the valve core seat has a cold water inlet, a cold water outlet, a hot water inlet, a hot water outlet, a sensor-operated mixed water inlet, a first accommodating chamber, a main water outlet, and a mechanically-operated mixed water inlet. The cold water outlet, the hot water outlet, the sensor-operated mixed water inlet and the mechanically-operated mixed water inlet are located on a same end face of the valve core seat. A first flow channel and a second flow channel are defined inside the valve core seat. The cold water inlet is in communication with the cold water outlet. The hot water inlet is in communication with the hot water outlet. The sensor-operated mixed water inlet is in communication with the first accommodating chamber via the first flow channel. The first accommodating chamber is in communication with the main water outlet via the second flow channel and is configured to accommodate a solenoid valve that controls opening and closing of the first flow channel and the second flow channel. The mechanically-operated mixed water inlet is in communication with the main water outlet.

Preferably, a third flow channel and a fourth flow channel are defined inside the valve core seat. The cold water inlet is in communication with the cold water outlet via the third flow channel. The hot water inlet is in communication with the hot water outlet via the fourth flow channel.

Preferably, the valve core seat has a receiving channel passing through the valve core seat and extending vertically for receiving a water outlet tube of a sensor-operated water discharge device. The first flow channel and the second flow channel are disposed beside the receiving channel.

Preferably, a fifth flow channel is defined inside the valve core seat. The fifth flow channel is arranged in parallel with the receiving channel. The second flow channel, the main water outlet and the mechanically-operated mixed water inlet are all in communication with the fifth flow channel. The cold water inlet, the hot water inlet and the main water outlet are all disposed on a lower surface of the valve core seat.

Preferably, the water discharge structure further comprises a first plug, a second plug, a third plug and a plurality of sealing rings that are tightly fitted with the valve core seat. The first flow channel has an open outlet end that is blocked by the first plug and a corresponding one of the sealing rings. The second flow channel has an open inlet end that is blocked by the second plug and a corresponding one of the sealing rings. The second flow channel further has an open upper surface that is blocked by the third plug and a corresponding one of the sealing rings.

A sensor-operated water discharge device comprises a water discharge structure, a valve core, a handle, a solenoid valve, a cold water inlet tube, a hot water inlet tube, and a water outlet tube. The water discharge structure comprises a valve core seat. A surface of the valve core seat has a cold water inlet, a cold water outlet, a hot water inlet, a hot water outlet, a sensor-operated mixed water inlet, a first accommodating chamber, a main water outlet, and a mechanically-operated mixed water inlet. The cold water outlet, the hot water outlet, the sensor-operated mixed water inlet and the mechanically-operated mixed water inlet are located on a same end face of the valve core seat. A first flow channel and a second flow channel are defined inside the valve core seat. The cold water inlet is in communication with the cold water outlet. The hot water inlet is in communication with the hot water outlet. The sensor-operated mixed water inlet is in communication with the first accommodating chamber via the first flow channel. The first accommodating chamber is in communication with the main water outlet via the second flow channel. The mechanically-operated mixed water inlet is in communication with the main water outlet. One end of the valve core has a first inlet, a second inlet, a first outlet, and a second outlet. The valve core is connected to the valve core seat. The first inlet is in communication with the cold water outlet. The second inlet is in communication with the hot water outlet. The first outlet is in communication with the mechanically-operated mixed water inlet. The second outlet is in communication with the sensor-operated mixed water inlet. The handle is fitted on another end of the valve core and configured to switch opening and closing of the first inlet, the second inlet, the first outlet and the second outlet. The solenoid valve is accommodated in the first accommodating chamber for controlling opening and closing of the first flow channel and the second flow channel. The cold water inlet tube is connected to the cold water inlet. The hot water inlet tube is connected to the hot water inlet. The water outlet tube is connected to the main water outlet.

Preferably, the sensor-operated water discharge device further comprises a faucet body, a valve core cap, a faucet spout, and a spray head. The water discharge structure and the valve core are installed in the faucet body and restricted by the valve core cap. One end of the faucet spout is connected to the faucet body. The spray head is installed at another end of the faucet spout. The water outlet tube is in communication with the spray head.

Preferably, the sensor-operated water discharge device further comprises a pull-out hose. The valve core seat has a receiving channel passing through the valve core seat and extending vertically. The pull-out hose is movably inserted through the receiving channel of the valve core seat. An outlet end of the water outlet tube is in communication with an inlet end of the pull-out hose. An outlet end of the pull-out hose is in communication with the spray head.

Preferably, the sensor-operated water discharge device further comprises a sensor. The faucet body has a sensor window. The sensor is installed in the sensor window and electrically connected to the solenoid valve.

Preferably, the sensor-operated water discharge device further comprises a first sealing member between the valve core seat and the valve core. Respective communication relationships between the first inlet and the cold water outlet, between the second inlet and the hot water outlet, between the first outlet and the mechanically-operated mixed water inlet and between the second outlet and the sensor-operated mixed water inlet are independent of each other.

Preferably, the valve core comprises a casing, an immovable plate, a movable plate unit, a bracket, and a lever. The cashing has a second accommodating chamber. One end of the second accommodating chamber has the first inlet, the second inlet, the first outlet, and the second outlet. The immovable plate, the movable plate unit and the bracket are sequentially fitted in the second accommodating chamber in a direction from one end to another end of the second accommodating chamber. The movable plate unit includes a first movable plate, a second movable plate, a first dial, and a second dial. The first movable plate and the first dial are coaxially connected. The second movable plate and the second dial are coaxially connected and movably fitted between the first movable plate and the first dial. A first restricting mechanism is disposed between the first dial and the casing. A second restricting mechanism is disposed between the second dial and the bracket. A middle portion of the lever is coaxially connected to the bracket so that the lever can swing relative to the bracket. One end of the lever is connected to the movable plate unit. Another end of the lever is connected to the handle. When the lever swings to be in an open state, the first restricting mechanism and the second restricting mechanism are in an unlocked state, the first inlet and the second inlet are in communication with the first outlet and are not in communication with the second outlet, and the lever is rotated to adjust a relative position of the first movable plate and the immovable plate, so as to adjust a water mixing ratio of the first inlet, the second inlet and the first outlet. When the lever swings to be in a closed state, the first restricting mechanism and the second restricting mechanism are in a locked state, the first inlet and the second inlet are in communication with the second outlet and are not in communication with the first outlet, and the lever is rotated to adjust a relative angle between the second movable plate and the first movable plate, so as to adjust a water mixing ratio of the first inlet, the second inlet and the second outlet.

Preferably, the casing includes a valve core body and a cover. The valve core body has the second accommodating chamber. One end of the valve core body has the first inlet, the second inlet, the first outlet, and the second outlet. The cover is connected to another end of the valve core body in a snap-fit manner. The cover has a mounting hole for insertion of the bracket.

Preferably, the immovable plate, the first movable plate and the second movable plate are ceramic plates.

Preferably, the first restricting mechanism includes a protruding post disposed in the second accommodating chamber and a guide groove disposed on a surface of the first dial. The guide groove is arranged along a radial direction of the first dial. The protruding post is movable between two ends of the guide groove when the lever swings. When the lever swings to be in the open state, the protruding post is located at the outer end of the guide groove, and the lever is rotated for the movable plate unit to swing along a radial direction of the casing with the protruding post as a fulcrum, so as to adjust the relative position of the first movable plate and the immovable plate.

Preferably, a first protruding block is disposed in the second accommodating chamber. The protruding post is disposed on the first protruding block. The bracket has a first notch. The first protruding block is movably fitted in the first notch along with rotation of the bracket. The protruding post passes through the first notch and is fitted in the guide groove.

Preferably, the first dial has a receiving chamber therein. The second movable plate and the second dial are movably fitted in the receiving chamber. The first dial further has an opening communicating with the receiving chamber. The second dial has a boss matching with the opening. The boss passes through the opening. The second restricting mechanism includes a second protruding block disposed on the bracket and a second notch formed on the boss. An arc length of the second notch is greater than a width of the second protruding block. When the lever swings to be in the open state, the second protruding block is separated from a circumferential path of the second notch. When the lever swings to be in the closed state, the second protruding block is located in the second notch, and the lever drives the bracket to rotate synchronously, so that the second protruding block abuts against one end of the second notch to drive the second dial and the second movable plate to rotate relative to the first movable plate.

Preferably, the one end of the lever is a ball joint. The second dial has a receiving groove. The ball joint is movably fitted in the receiving groove. The second notch is disposed on a side wall of one end of the receiving groove.

Preferably, an edge of the immovable plate has a first restricting notch. A first restricting block is disposed on a side wall of the second accommodating chamber. The first restricting block is engaged in the first restricting notch. Edges of mating surfaces of the first dial and the first movable plate have a second restricting block and a second restricting notch. The second restricting block is engaged in the second restricting notch. Edges of mating surfaces of the second dial and the second movable plate have a third restricting block and a third restricting notch. The third restricting block is engaged in the third restricting notch.

Preferably, the immovable plate further has two first perforations, a second perforation, and a third perforation. The two first perforations are in communication with the first inlet and the second inlet, respectively. The second perforation is in communication with the first outlet. The third perforation is in communication with the second outlet. The first movable plate further has two fourth perforations, a first groove, and a fifth perforation. The two fourth perforations are aligned with the two first perforations, respectively. When the first movable plate is moved relative to the immovable plate, the first groove is in communication with the first perforations and the second perforation, or the fifth perforation is in communication with the third perforation. The second movable plate further has a second groove and two stop blocks in the second groove. The fourth perforations and the fifth perforation are in communication with the second groove. The stop blocks are configured to block the corresponding fourth perforations for changing water flow when the second movable plate is rotated relative to the first movable plate.

Preferably, the sensor-operated water discharge device further comprises a second sealing member disposed between an end wall of the second accommodating chamber and the immovable plate. The second sealing member has a first through hole, a second through hole and a third through hole corresponding to the first perforations, the second perforation and the third perforation, respectively.

Preferably, the first outlet is disposed at a middle position of one end of the casing. The first inlet, the second inlet and the second outlet are disposed beside the first outlet. The second outlet includes at least one second outlet.

Preferably, an annular step is formed on a peripheral surface of the one end of the casing. A sealing ring is sleeved on the step. The end face of the valve core seat, having the cold water outlet, is a recessed end face and is fitted on the step. The sealing ring is configured to seal a junction of the valve core and the valve core seat.

By adopting the above-mentioned technical solutions, the present invention has the following technical effects:

1. The cold water outlet, the hot water outlet, the sensor-operated mixed water inlet and the mechanically-operated mixed water inlet are all located on the same end face of the valve core seat, which is convenient for assembling with the valve core of the sensor-operated water discharge device and realizes waterway communication, so that the sensor-operated water discharge device has a sensor-operated mode and a mechanically-operated mode to discharge water, so as to meet the needs of different users.
2. The first accommodating chamber is configured to accommodate the solenoid valve that controls opening and closing of the first flow channel and the second flow channel, so as to realize opening and closing of the sensor-operated mixed water inlet and the main water outlet. The solenoid valve can be directed installed in the water discharge structure to form an integral structure when the sensor-operated water discharge device leaves the factory. After purchase, the user only needs to connect the cold water inlet tube, the hot water inlet tube and the water outlet tube with the sensor-operated water discharge device. The cold water inlet tube is connected to the cold water inlet. The hot water inlet tube is connected to the hot water inlet. The water outlet tube is connected to the main water outlet.
3. The mechanically-operated mixed water inlet is also in communication with the main water outlet. Only one water outlet tube is required. The overall structure is simplified, the volume is smaller, and the installation in a narrow space is easier.

DETAILED DESCRIPTION OF THE PREFERRED EMBODIMENTS

Figure 1:
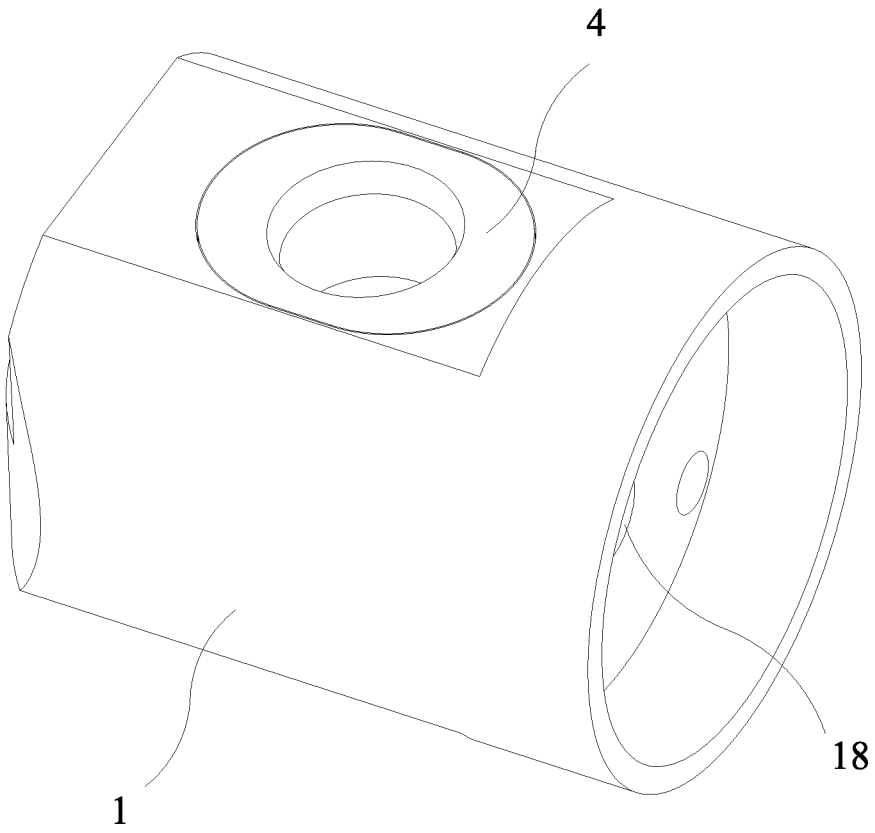
FIG. 1 is a perspective view of the water discharge structure according to an embodiment of the present invention.
Figure 2:
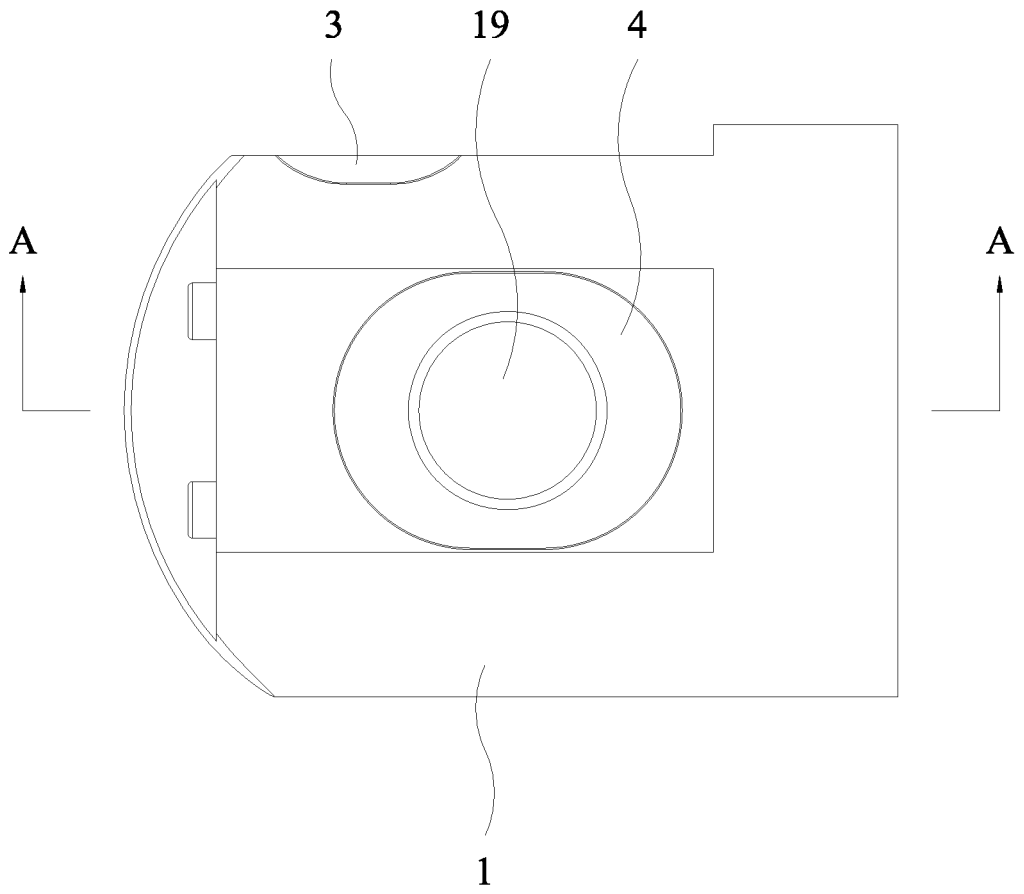
FIG. 2 is a top view of the water discharge structure according to the embodiment of the present invention.
Figure 3:
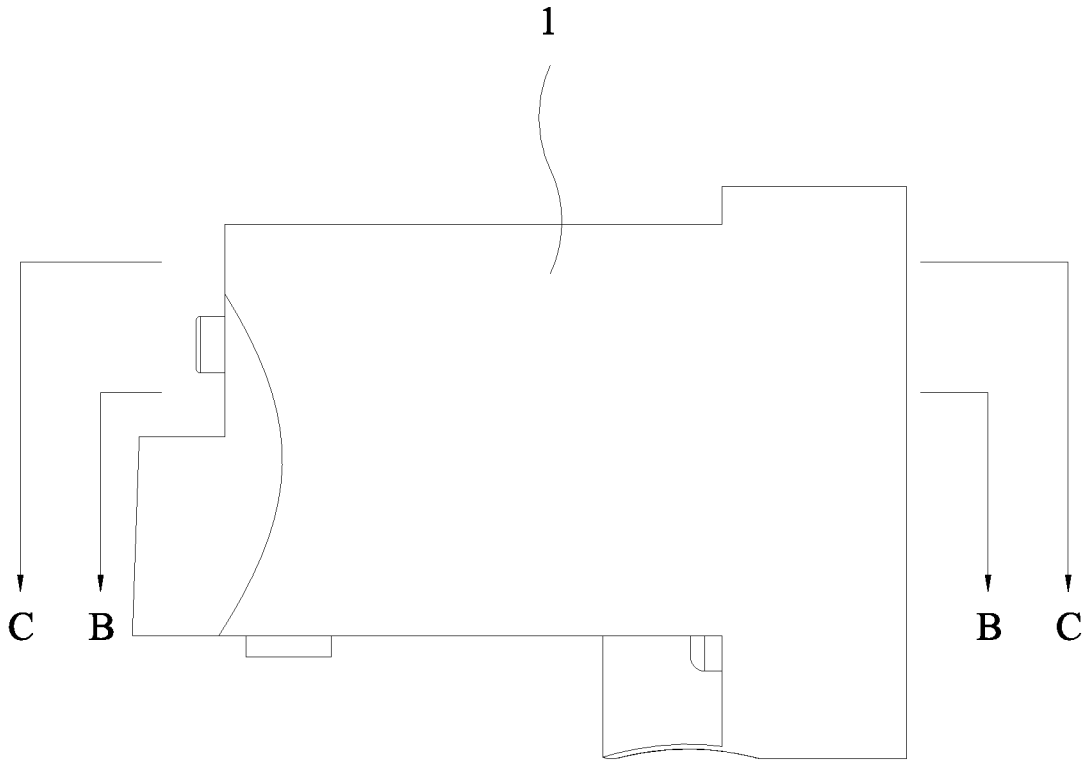
FIG. 3 is a front view of the water discharge structure according to the embodiment of the present invention.
Figure 4:
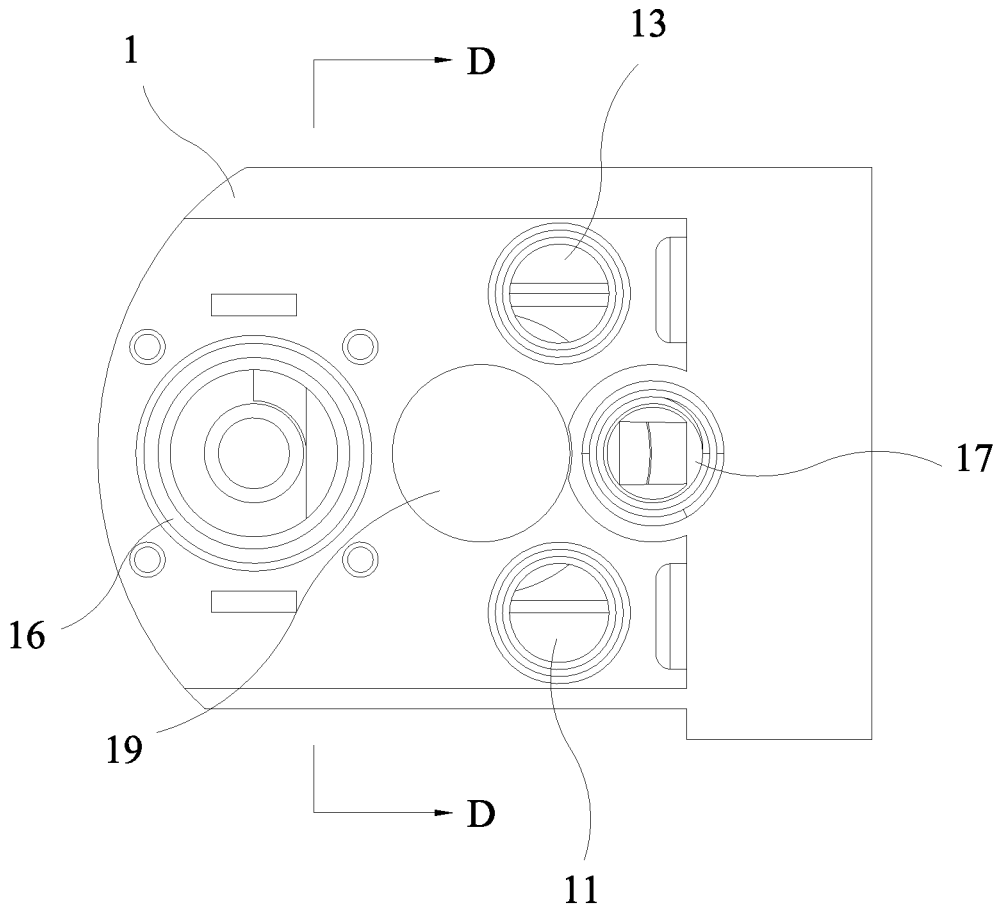
FIG. 4 is a bottom view of the water discharge structure according to the embodiment of the present invention.
Figure 5:
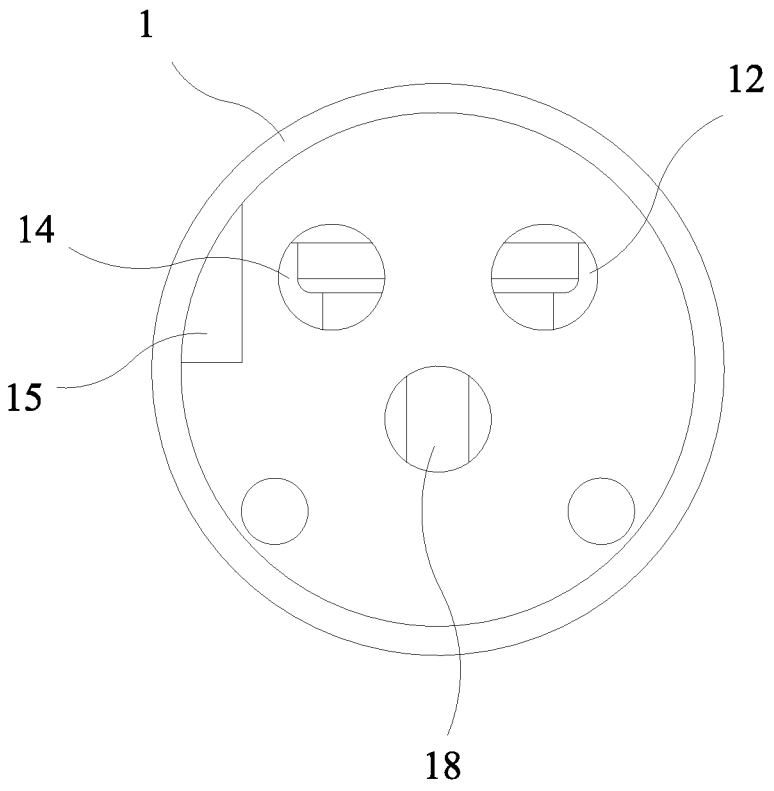
FIG. 5 is a right view of the water discharge structure according to the embodiment of the present invention.
Figure 6:
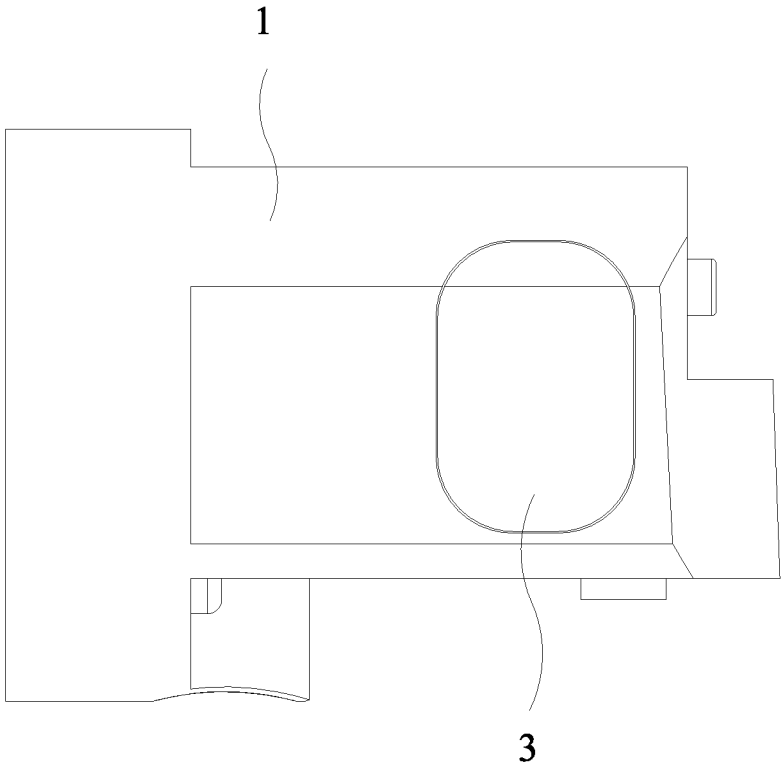
FIG. 6 is a rear view of the water discharge structure according to the embodiment of the present invention.
Figure 7:
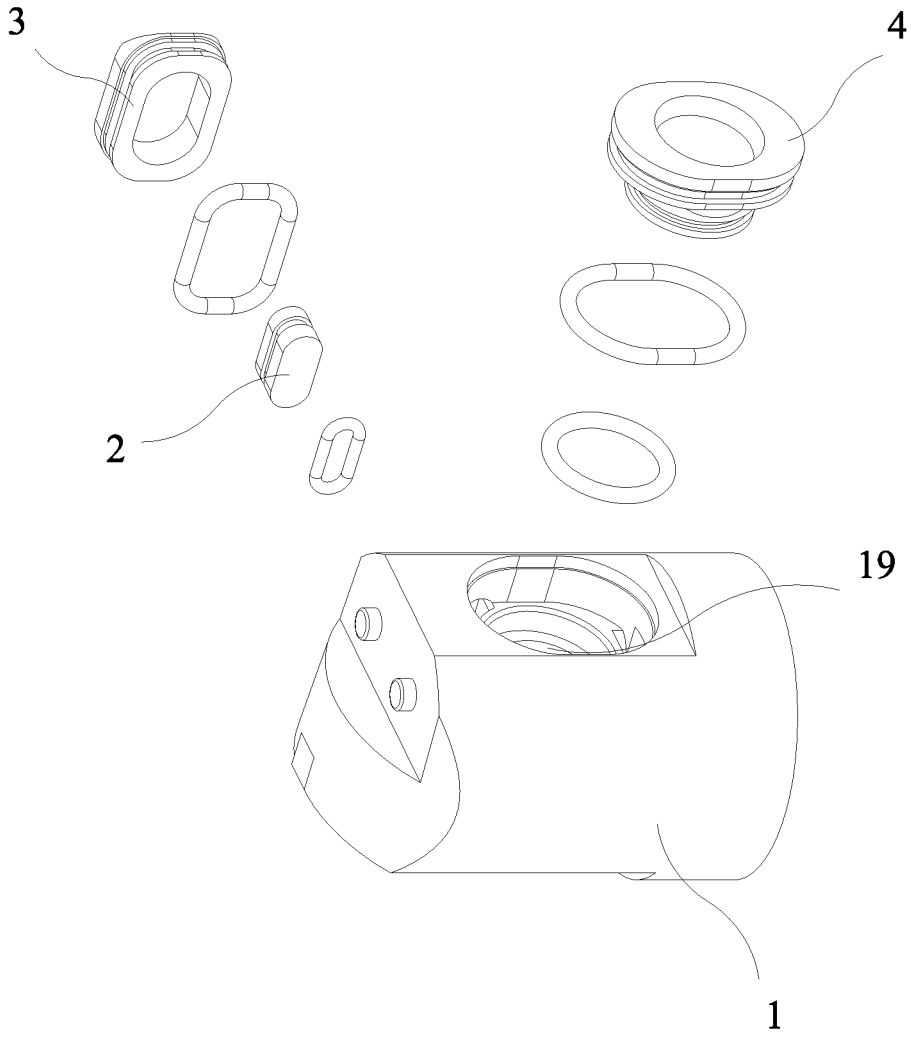
FIG. 7 is an exploded view of the water discharge structure according to the embodiment of the present invention.
Figure 8:
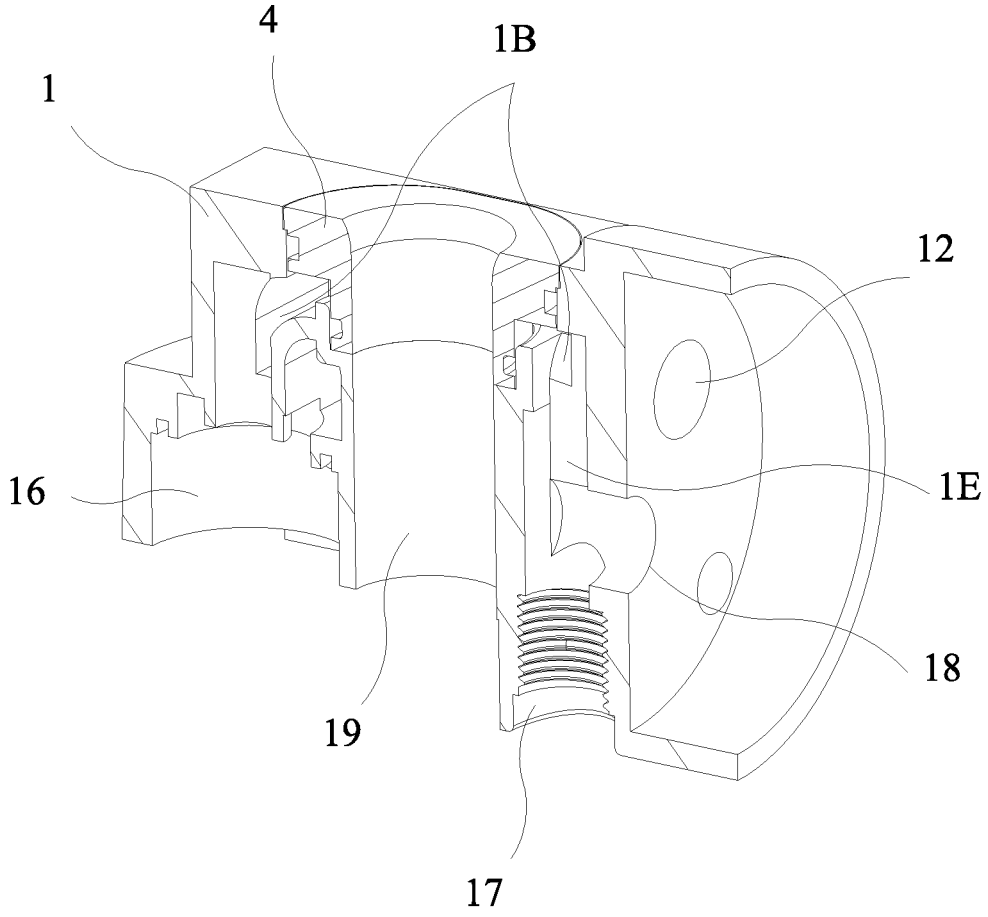
FIG. 8 is a cross-sectional view taken along line A-A of FIG. 2.
Figure 9:
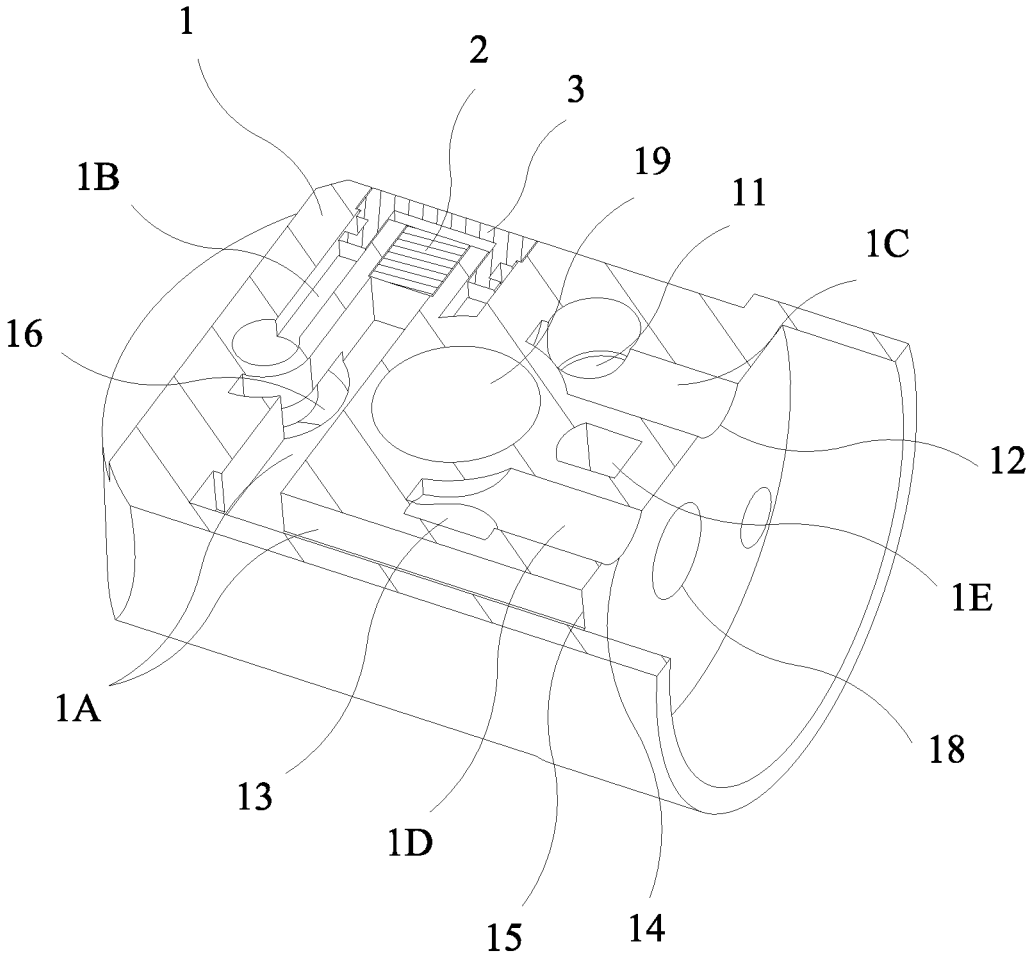
FIG. 9 is a cross-sectional view taken along line B-B of FIG. 3.
Figure 10:
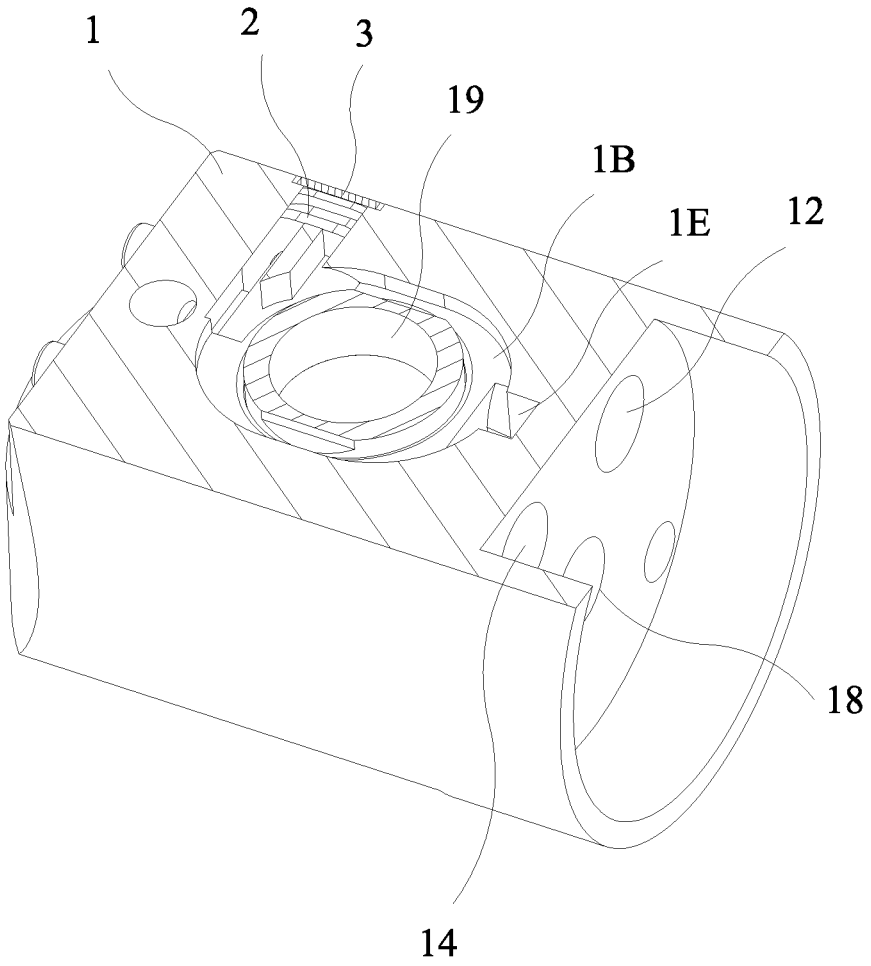
FIG. 10 is a cross-sectional view taken along line C-C of FIG. 3.
Figure 11:
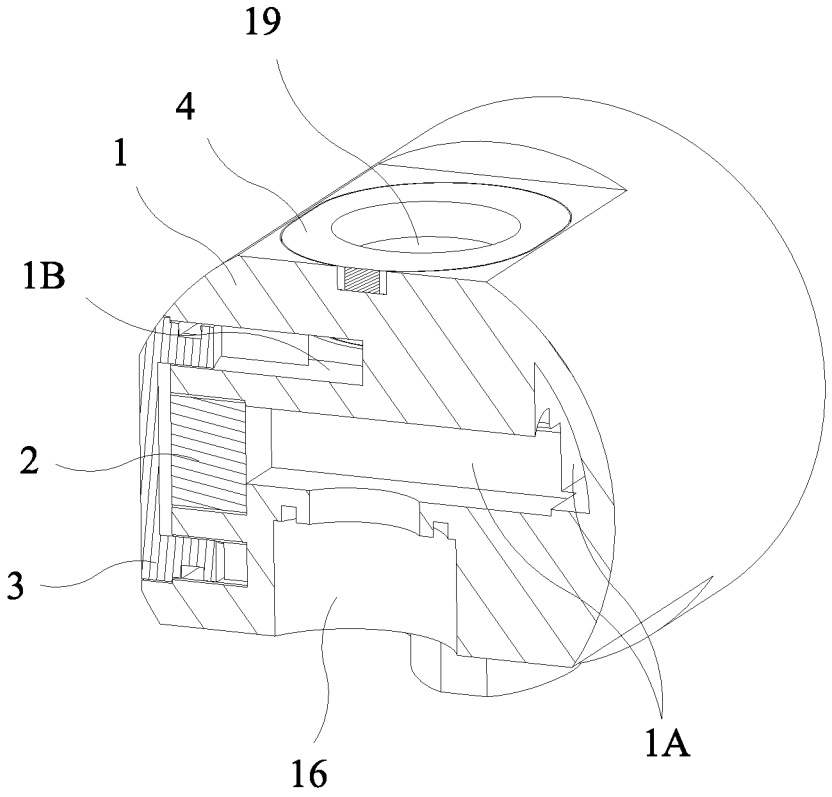
FIG. 11 is a cross-sectional view taken along line D-D of FIG. 4.
Figure 12:
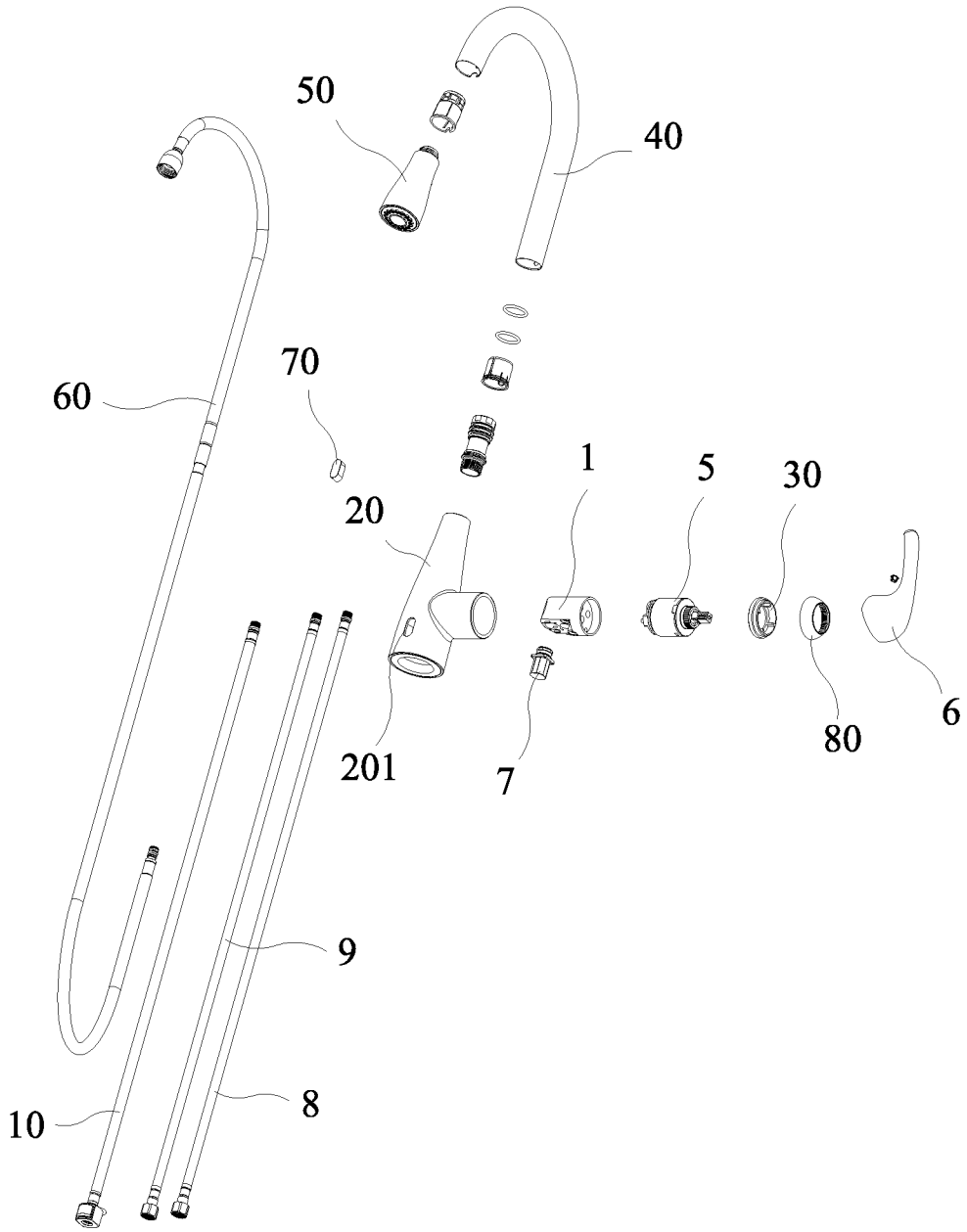
FIG. 12 is an exploded view of the sensor-operated water discharge device according to an embodiment of the present invention.

The present invention discloses a water discharge structure, comprising a valve core seat 1. The surface of the valve core seat 1 has a cold water inlet 11, a cold water outlet 12, a hot water inlet 13, a hot water outlet 14, a sensor-operated mixed water inlet 15, a first accommodating chamber 16, a main water outlet 17, and a mechanically-operated mixed water inlet 18. The cold water outlet 12, the hot water outlet 14, the sensor-operated mixed water inlet 15 and the mechanically-operated mixed water inlet 18 are all located on the same end face of the valve core seat 1. A first flow channel 1A and a second flow channel 1B are defined inside the valve core seat 1.

The cold water inlet 11 is in communication with the cold water outlet 12.

The hot water inlet 13 is in communication with the hot water outlet 14.

The sensor-operated mixed water inlet 15 is in communication with the first accommodating chamber 16 via the first flow channel 1A.

The first accommodating chamber 16 is in communication with the main water outlet 17 via the second flow channel 1B, and is configured to accommodate a solenoid valve 7 that controls opening and closing of the first flow channel 1A and the second flow channel 1B.

The mechanically-operated mixed water inlet 18 is in communication with the main water outlet 17.

Through the above technical solution, the cold water outlet 12, the hot water outlet 14, the sensor-operated mixed water inlet 15 and the mechanically-operated mixed water inlet 18 are all located on the same end face of the valve core seat 1. It is convenient to assemble the valve core seat and a valve core 5 of a sensor-operated water discharge device and realize communication of waterway, so that the sensor-operated water discharge device has a sensor-operated mode and a mechanically-operated mode to discharge water, so as to meet the needs of different users. The first accommodating chamber 16 is configured to accommodate the solenoid valve 7 that controls opening and closing of the first flow channel 1A and the second flow channel 1B, so as to realize opening and closing of the sensor-operated mixed water inlet 15 and the main water outlet 17. The solenoid valve 7 can be directed installed in the water discharge structure to form an integral structure when the sensor-operated water discharge device leaves the factory. After purchase, the user only needs to connect a cold water inlet tube 8, a hot water inlet tube 9 and a water outlet tube 10 with the sensor-operated water discharge device. The cold water inlet tube 8 is connected to the cold water inlet 11. The hot water inlet tube 9 is connected to the hot water inlet 13. The water outlet tube 10 is connected to the main water outlet 17. The mechanically-operated mixed water inlet 18 is also in communication with the main water outlet 17. Only one water outlet tube 10 is needed. The overall structure is simplified, the volume is smaller, and the installation in a narrow space is easier.

Referring to FIGS. 1 to 11, a specific embodiment of the water discharge structure is shown.

A third flow channel 1C and a fourth flow channel 1D are defined inside the valve core seat 1.

The cold water inlet 11 is in communication with the cold water outlet 12 via the third flow channel 1C. The hot water inlet 13 is in communication with the hot water outlet 14 via the fourth flow channel 1D.

The valve core seat 1 has a receiving channel 19 passing through the valve core seat 1 and extending vertically. The receiving channel 19 facilitates the water outlet tube 10 of the sensor-operated water discharge device to pass through the valve core seat 1 in a vertical direction. There is no need for the water outlet tube 10 to be arranged around the valve core seat 1, so that the sensor-operated water discharge device can be designed to be smaller in size. Besides, both the first flow channel 1A and the second flow channel 1B are disposed beside the receiving channel 19.

Further, a fifth flow channel 1E is defined inside the valve core seat 1. The fifth flow channel 1E is arranged in parallel with the receiving channel 19. The second flow channel 1B, the main water outlet 17 and the mechanically-operated mixed water inlet 18 are all in communication with the fifth flow channel 1E. The cold water inlet 11, the hot water inlet 13 and the main water outlet 17 are all disposed on the lower surface of the valve core seat 1. That is to say, the user can install the water inlet tubes and the water outlet tube in the same direction of the valve core seat 1. The operation is more convenient. Through the design of the fifth flow channel 1E, the communication between the corresponding inlet and outlet is realized, and the internal structure of the valve core seat 1 is simplified, so that the valve core seat 1 can be designed to be smaller in size.

The water discharge structure further includes a first plug 2, a second plug 3, a third plug 4 and a plurality of sealing rings that are tightly fitted with the valve core seat 1. The first flow channel 1A has an open outlet end that is blocked by the first plug 2 and a corresponding one of the sealing rings. The second flow channel 1B has an open inlet end that is blocked by the second plug 3 and a corresponding one of the sealing rings. The second flow channel 1B further has an open upper surface that is blocked by the third plug 4 and a corresponding one of the sealing rings. The relative positions of the first flow channel 1A and the second flow channel 1B are designed to have open ends, which can facilitate the shaping of the first flow channel 1A and the second flow channel 1B when the valve core seat 1 is produced and realize the reasonable use of the space inside the valve core seat 1, so that the valve core seat 1 can be designed to be smaller in size. Afterwards, the open ends are blocked by the corresponding plugs and sealing rings, so that the first flow channel 1A and the second flow channel 1B are closed to avoid water leakage and ensure the sealing performance of the valve core seat 1.

The present invention further discloses a sensor-operated water discharge device, comprising the foregoing water discharge structure, a valve core 5, a handle 6, a solenoid valve 7, a cold water inlet tube 8, a hot water inlet tube 9, and a water outlet tube 10.

One end of the valve core 5 has a first inlet 5112, a second inlet 5113, a first outlet 5114, and a second outlet 5115. The valve core 5 is connected to the valve core seat 1. The first inlet 5112 is in communication with the cold water outlet 12. The second inlet 5113 is in communication with the hot water outlet 14. The first outlet 5114 is in communication with the mechanically-operated mixed water inlet 18. The second outlet 5115 is in communication with the sensor-operated mixed water inlet 15.

The handle 6 is fitted on the other end of the valve core 5, and is configured to switch opening and closing of the first inlet 5112, the second inlet 5113, the first outlet 5114 and the second outlet 5115.

The solenoid valve 7 is accommodated in the first accommodating chamber 16 for controlling opening and closing of the first flow channel 1A and the second flow channel 1B.

The cold water inlet tube 8 is connected to the cold water inlet 11.

The hot water inlet tube 9 is connected to the hot water inlet 13.

The water outlet tube 10 is connected to the main water outlet 17.

Referring to FIGS. 12 to 20, a specific embodiment of the sensor-operated water discharge device is shown.

In this embodiment of the sensor-operated water discharge device, the sensor-operated water discharge device is a sensor faucet. The sensor-operated water discharge device further includes a faucet body 20, a valve core cap 30, a faucet spout 40, and a spray head 50. The water discharge structure and the valve core 5 are installed in the faucet body 20 and restricted by the valve core cap 30. One end of the faucet spout 40 is connected to the faucet body 20. The spray head 50 is installed at the other end of the faucet spout 40. The water outlet tube is in communication with the spray head 50. The spray head 50 may be a simple filtering device, or a device that can change water to spray in different manners (such as ordinary water, shower water, foamy water, etc.).

Further, the sensor faucet is a pull-out faucet. The sensor-operated water discharge device further comprises a pull-out hose 60. The pull-out hose 60 is movably inserted through the receiving channel 19 of the valve core seat 1. An outlet end of the water outlet tube 10 is in communication with an inlet end of the pull-out hose 60. An outlet end of the pull-out hose 60 is in communication with the spray head 50.

The sensor-operated water discharge device further comprises a sensor 70. The faucet body 20 has a sensor window 201. The sensor 70 is installed in the sensor window 201 and is electrically connected to the solenoid valve 7. The sensor 70 may be an infrared sensor or a photo sensor. Alternatively, the sensor 70 is a light-pervious member with a built-in infrared sensor or photo sensor, which can close the sensor window 201 while realizing the motion-sensing function of the solenoid valve 7.

Furthermore, the sensor-operated water discharge device further comprises a decorative cover 80 covering the surface of the valve core cap 30, such as a semicircular spherical cover. The other end of the valve core 5 passes through the decorative cover 80 and is connected to the handle 6. The decorative cover 80 plays a covering role to keep the appearance of the sensor-operated water discharge device neat.

In addition, the sensor-operated water discharge device further comprises a first sealing member 90 between the valve core seat 1 and the valve core 5, so that the respective communication relationships between the first inlet 5112 and the cold water outlet 12, between the second inlet 5113 and the hot water outlet 14, between the first outlet 5114 and the mechanically-operated mixed water inlet 18 and between the second outlet 5115 and the sensor-operated mixed water inlet 15 are independent of each other. No water leakage occurs.

The valve core 5 cooperates with the handle 6 to realize the adjustment (that is, adjustment of water temperature) of the mixing ratio of cold water and hot water in a sensor-operated mode and a mechanically-operated mode under the operation of the user. The existing valve core 5 can realize its basic function. However, the adjustment of water temperature in the two modes of the valve core 5 is synchronous and not independent. For example, after the user adjusts the water temperature of the sensor-operated mode, if the user uses the mechanically-operated mode and adjusts the water temperature, he/she needs to adjust the water temperature again when using the sensor-operated mode next time. The user experience is poor. Besides, after adjusting the water temperature, it is necessary to keep the handle at the present rotation angle so as not to affect the water temperature of the sensor-operated mode. The handle cannot be returned to the center position, which is not in line with the usage habits of some users. Therefore, the valve core 5 is improved as described below.

Figure 13:
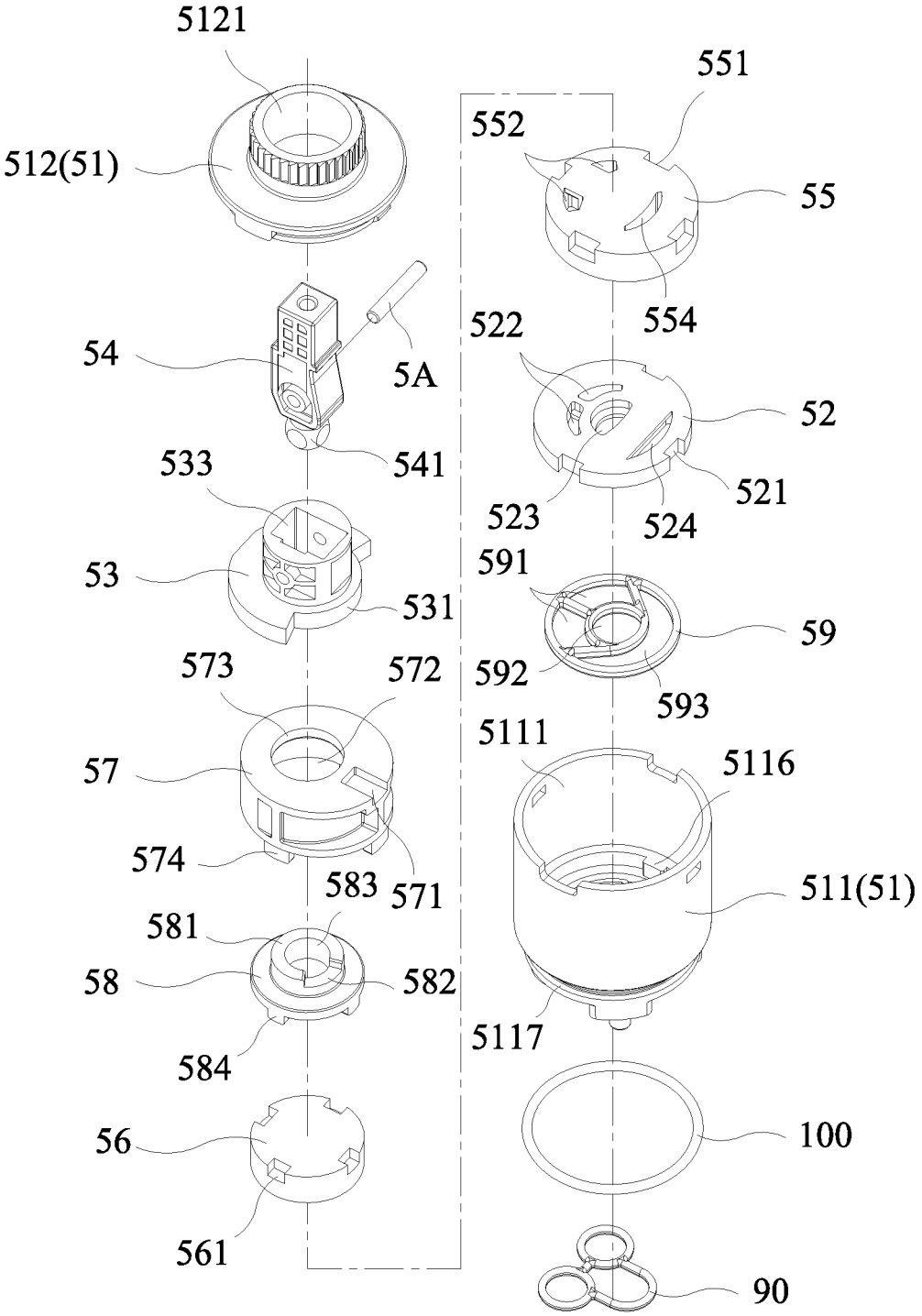
FIG. 13 is a first exploded view of the valve core according to the embodiment of the present invention.
Figure 14:
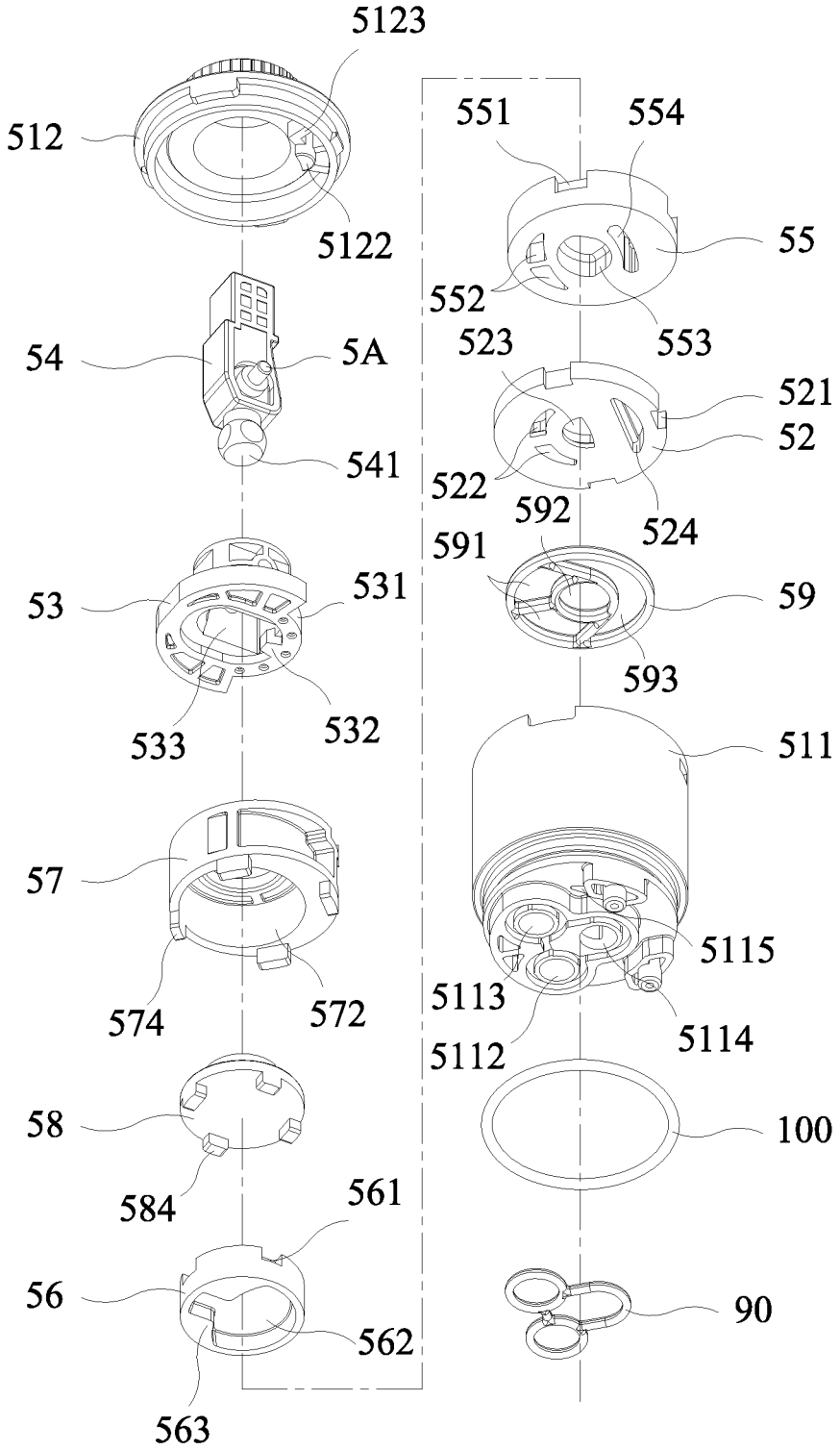
FIG. 14 is a second exploded view of the valve core according to the embodiment of the present invention.

As shown in FIG. 13 and FIG. 14, the valve core 5 comprises a casing 51, an immovable plate 52, a movable plate unit, a bracket 53, and a lever 54. The cashing 51 has a second accommodating chamber 5111. One end of the accommodating chamber 111 has the first inlet 5112, the second inlet 5113, the first outlet 5114, and the second outlet 5115. The immovable plate 52, the movable plate unit and the bracket 53 are sequentially fitted in the second accommodating chamber 5111 in a direction from one end to the other end of the second accommodating chamber 5111.

The movable plate unit includes a first movable plate 55, a second movable plate 56, a first dial 57, and a second dial 58. The first movable plate 55 and the first dial 57 are coaxially connected. The second movable plate 56 and the second dial 58 are coaxially connected and movably fitted between the first movable plate 55 and the first dial 57. A first restricting mechanism is disposed between the first dial 57 and the casing 51. A second restricting mechanism is disposed between the second dial 58 and the bracket 53.

A middle portion of the lever 54 is coaxially connected to the bracket 53, so that the lever 54 can swing relative to the bracket 53. One end of the lever 54 is connected to the movable plate unit, and the other end of the lever 54 is connected to the handle 6.

When the lever 54 swings to be in an open state, the first restricting mechanism and the second restricting mechanism are in an unlocked state, the first inlet 5112 and the second inlet 5113 are in communication with the first outlet 5114 and are not in communication with the second outlet 5115, and the lever 54 is rotated to adjust the relative position of the first movable plate 55 and the immovable plate 52, so as to adjust the water mixing ratio of the first inlet 5112, the second inlet 5113 and the first outlet 5114.

When the lever 54 swings to be in a closed state, the first restricting mechanism and the second restricting mechanism are in a locked state, the first inlet 5112 and the second inlet 5113 are in communication with the second outlet 5115 and are not in communication with the first outlet 5114, and the lever 54 is rotated to adjust the relative angle between the second movable plate 56 and the first movable plate 55, so as to adjust the water mixing ratio of the first inlet 5112, the second inlet 5113 and the second outlet 5115.

With the above solution of the valve core 5, the immovable plate 52, the first movable plate 55 and the second movable plate 56 are disposed in the casing 51 as a waterway switching mechanism. The first restricting mechanism is disposed between the first dial 57 and the casing 51, and the second restricting mechanism is disposed between the second dial 58 and the bracket 53. Through different actions of the lever 54, the restricting mechanisms can be locked or unlocked. Thereby, different adjustments of the movable plate unit relative to the immovable plate 52 can be realized under the different actions of the lever 54. The opening and closing of the first inlet 5112, the second inlet 5113 and the first outlet 5114/the second outlet 5115 and the water mixing ratio are independent of each other, so that the temperature-adjusting operations of the sensor-operated mode and the mechanically-operated mode of the sensor-operated water discharge device do not interfere with each other, which can meet various usage needs and improve user experience.

In some embodiments of the valve core 5, the casing 51 includes a valve core body 511 and a cover 512. The valve core body 511 has the second accommodating chamber 5111. One end of the valve core body 511 has the first inlet 5112, the second inlet 5113, the first outlet 5114, and the second outlet 5115. The cover 512 is connected to the other end of the valve core body 511 in a snap-fit manner. The cover 512 has a mounting hole 5121 for insertion of the bracket 53.

In some embodiments of the valve core, the immovable plate 52, the first movable plate 55 and the second movable plate 56 are all ceramic plates, which have the advantages of high wear resistance, high sealing performance, and long service life.

In some embodiments of the valve core, the first restricting mechanism includes a protruding post 5122 disposed in the second accommodating chamber 5111 (namely, the inner side of the cover 512) and a guide groove 571 disposed on the surface of the first dial 57. The guide groove 571 is arranged along the radial direction of the first dial 57. The protruding post 5122 is movable between two ends of the guide groove 571 when the lever 54 swings. When the lever 54 swings to be in the open state, the protruding post 5122 is located at the outer end of the guide groove 571. The lever 54 is rotated for the movable plate unit to swing along the radial direction of the casing 51 with the protruding post 5122 as the fulcrum to adjust the relative position of the first movable plate 55 and the immovable plate 52, so as to adjust the water mixing ratio of the first inlet 5112, the second inlet 5113 and the first outlet 5114. When the lever 54 swings to be in the closed state, the protruding post 5122 is located at the inner end of the guide groove 571. When the lever 54 is rotated, the first dial 57 and the first movable plate 55 are not rotated. That is, when the lever 54 is in the closed state, the first movable plate 55 cannot be adjusted, but only the second movable plate 56 can be adjusted.

Furthermore, a first protruding block 5123 is disposed in the second accommodating chamber 5111. The protruding post 5122 is disposed on the first protruding block 5123. The bracket 53 has a first notch 531. The first protruding block 5123 is movably fitted in the first notch 531 along with rotation of the bracket 53. The protruding post 5122 passes through the first notch 531 and is fitted in the guide groove 571. Because the position of the first protruding block 5123 is immovable, the rotation range of the bracket 53 is restricted under the cooperation of the first protruding block 5123 and the first notch 531, thereby restricting the angle range the lever 54 (the handle 6) rotated by the user.

In some embodiments of the valve core, the first dial 57 has a receiving chamber 572 therein. The second movable plate 56 and the second dial 58 are movably fitted in the receiving chamber 572. The first dial 57 further has an opening 573 communicating with the receiving chamber 572. The second dial 58 has a boss 581 matching with the opening 573. The boss 581 passes through the opening 573. The second restricting mechanism includes a second protruding block 532 disposed on the bracket 53 and a second notch 582 formed on the boss 581. The arc length of the second notch 582 is greater than the width of the second protruding block 532. When the lever 54 swings to be in the open state, the second protruding block 532 is separated from the circumferential path of the second notch 582. When the lever 54 swings to be in the closed state, the second protruding block 532 is located in the second notch 582. The lever 54 drives the bracket 53 to rotate synchronously, so that the second protruding block 532 abuts against the end of the second notch 582 to drive the second dial 58 and the second movable plate 56 to rotate relative to the first movable plate 55, so as to adjust the water mixing ratio of the first inlet 5112, the second inlet 5113 and the second outlet 5115. The second notch 582 with an arc length greater than the width of the second protruding block 532 is disposed on the boss 581, so that when the lever 54 is returned to the center position, the second notch 582 provides a space for movement of the second protruding block 532. The movement of the second protruding block 532 no longer pushes the second dial 58 to be returned. That is, the user can return the handle 6 after adjusting the water temperature of the sensor-operated mode, without changing the water temperature of the sensor-operated mode.

Further, one end of the lever 54 is a ball joint 541. The second dial 58 has a receiving groove 583. The ball joint 541 is movably fitted in the receiving groove 583. The second notch 582 is disposed on the side wall of one end of the receiving groove 583. As the lever 54 swings, the ball joint 541 rotates in the receiving groove 583 and pushes the second dial 58. Because the second dial 58 and the second movable plate 56 are located between the first dial 57 and the first movable plate 55, when the lever 54 swings, it can drive the entire movable plate unit to move along the radial plane of the casing 51, thereby changing the relative position of the first movable plate 55 and the immovable plate 52.

In some embodiments of the valve core, the edge of the immovable plate 52 has a first restricting notch 521. A first restricting block 5116 is disposed on the side wall of the second accommodating chamber 5111. The first restricting block 5116 is engaged in the first restricting notch 521 to secure the immovable plate 52 in the second accommodating chamber 5111. The edges of the mating surfaces of the first dial 57 and the first movable plate 55 have a second restricting block 574 and a second restricting notch 551. The second restricting block 574 is engaged in the second restricting notch 551 to realize the coaxial connection between the first dial 57 and the first movable plate 55. The edges of the mating surfaces of the second dial 58 and the second movable plate 56 have a third restricting block 584 and a third restricting notch 561. The third restricting block 584 is engaged in the third restricting notch 561 to realize the coaxial connection of the second dial 58 and the second movable plate 56.

In some embodiments of the valve core 5, the immovable plate 52 further has two first perforations 522, a second perforation 523 and a third perforation 524. The two first perforations 522 are in communication with the first inlet 5112 and the second inlet 5113, respectively. The second perforation 523 is in communication with the first outlet 5114. The third perforation 524 is in communication with the second outlet 5115. The first movable plate 55 further has two fourth perforations 552, a first groove 553, and a fifth perforation 554. The two fourth perforations 552 are aligned with the two first perforations 522, respectively. When the first movable plate 55 is moved relative to the immovable plate 52, the first groove 553 is in communication with the first perforations 522 and the second perforation 523, or the fifth perforation 554 is in communication with the third perforation 524. The second movable plate 56 further has a second groove 562 and two stop blocks 563 in the second groove 562. The fourth perforations 552 and the fifth perforation 554 are in communication with the second groove 562. The stop blocks 563 are configured to block the corresponding fourth perforations 552 for changing water flow when the second movable plate 56 is rotated relative to the first movable plate 55, so as to realize the adjustment of water temperature. The waterways formed by the immovable plate 52, the first movable plate 55 and the second movable plate 56 are described below. One waterway is that the water flows through the first inlet 5112, the first perforations 522, the first groove 553 and the second perforation 523 to the first outlet 5114. Another waterway is that water flows through the first inlet 5112, the first perforations 522, the fourth perforations 552, the second groove 562, the fifth perforation 554 and the third perforation 524 to the second outlet 5115. The movement of the movable plate unit (i.e., the first movable plate 55) relative to the immovable plate 52 determines that the first groove 553 is in communication with the first perforations 522 and the second perforation 523, or that the fifth perforation 554 is in communication with the first perforations 522, the fourth perforations 552, the second groove 562 and the third perforation 524. That is to say, it determines that the mechanically-operated mode or the sensor-operated mode is actuated. The water mixing ratio of the mechanically-operated mode (that is, the water flows out from the first outlet 5114) is determined by the relative position of the first movable plate 55 and the immovable plate 52. The water mixing ratio of the sensor-operated mode (that is, the water flows out from the second outlet 5115) is determined by the relative angle between the second movable plate 56 and the first movable plate 55.

Further, the valve core 5 further comprises a second sealing member 59 disposed between the end wall of the second accommodating chamber 5111 and the immovable plate 52. The second sealing member 59 has a first through hole 591, a second through hole 592 and a third through hole 593 corresponding to the first perforations 522, the second perforation 523 and the third perforation 524 respectively, so as to ensure the sealing of the junction of the first perforations 522 and the first inlet 5112/the second inlet 5113; the second perforation 523 and the first outlet 5114; the third perforation 524 and the second outlet 5115, respectively.

In some embodiments of the valve core, the first outlet 5114 is disposed at the middle position of the end of the casing 51. The first inlet 5112, the second inlet 5113 and the second outlet 5115 are disposed beside the first outlet 5114. The second outlet 5115 may be single or plural. When the second outlet 5115 is plural, the limited space at the end of the casing 51 can be more reasonably utilized in design, so as to ensure the water flow.

Furthermore, an annular step 5117 is formed on the peripheral surface of one end of the casing 51 (namely, the valve core body 511). A sealing ring 100 is sleeved on the step 5117. The end face of the valve core seat 1, having the cold water outlet 12, etc., is a recessed end face and is fitted on the step 5117. The sealing ring 100 is configured to seal the junction of the valve core 5 and the valve core seat 1 to ensure the sealing effect. Compared with the sealing design on the end face of the casing 51 where the first inlet 5112, the second inlet 5113, etc. are arranged, the sealing ring 100 on the step 5117 on the peripheral surface of the casing 51 can avoid occupying the design space of the end face of the casing 51, thereby ensuring sufficient space for designing the cross-sectional area of the second outlet 5115 to spray water. Besides, the seal is located on the peripheral surface of the casing 51, and the direction of its elastic force is perpendicular to the direction of water flowing in and out between the casing 51 and the valve core seat 1, which can reduce the possibility of the two being loosened due to excessive water pressure.

In some embodiments of the valve core, the bracket 53 has a receiving hole 533 for the lever 54 to be movably fitted in the receiving hole 533. A rotating shaft 5A passes through the middle of the lever 54 and is rotatably connected to the side wall of the receiving hole 533 to realize the coaxial connection of the lever 54 and the bracket 53. The lever 54 swings relative to the bracket 53 with the rotating shaft 5A as the axis for driving the movable plate unit. The receiving hole 533 provides a swing space for the lever 54.

The water spray principle of the sensor-operated water discharge device is described below.

Figure 15:
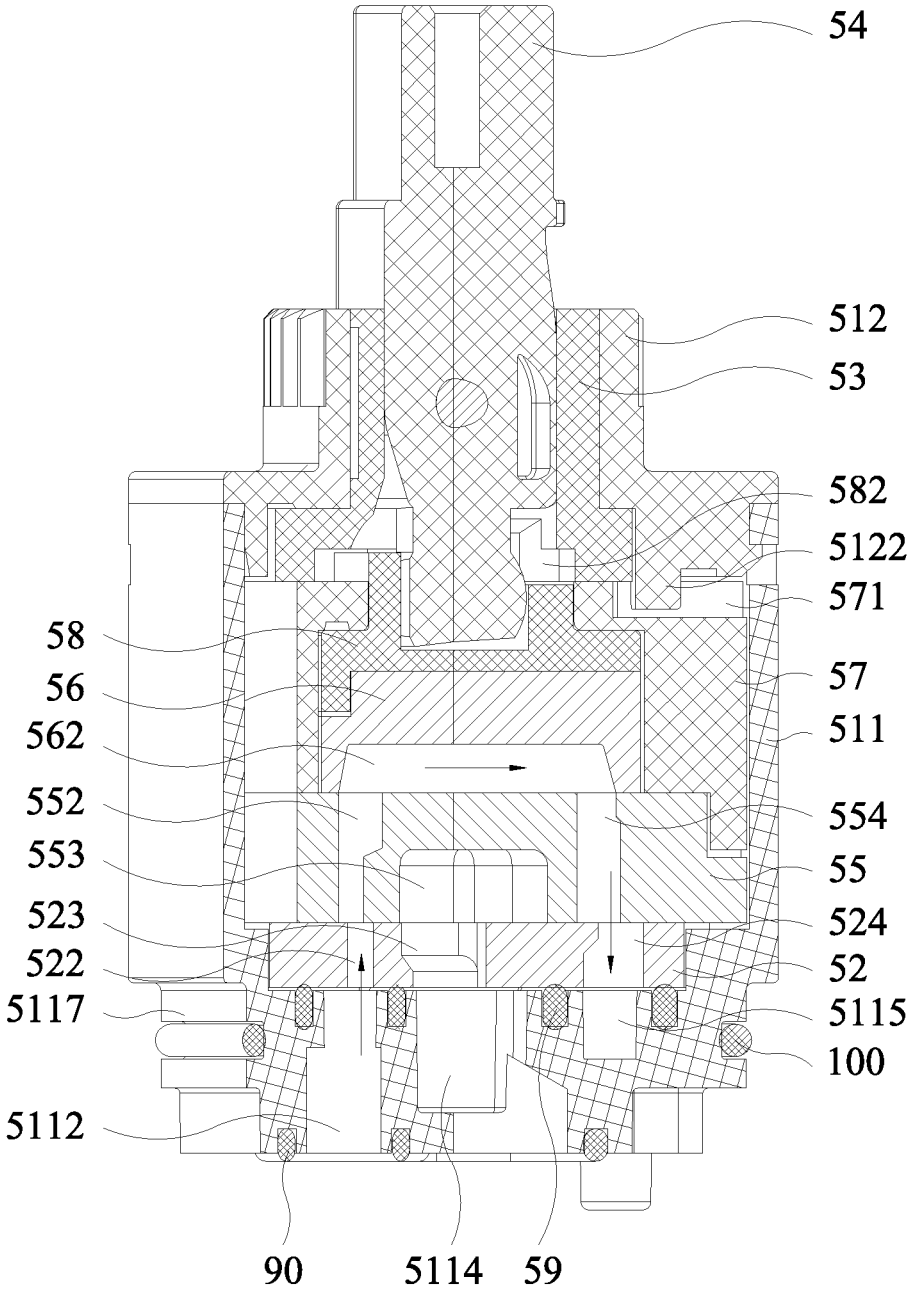
FIG. 15 is a first schematic view according to the embodiment of the present invention, wherein the lever swings to be in the closed state.
Figure 16:
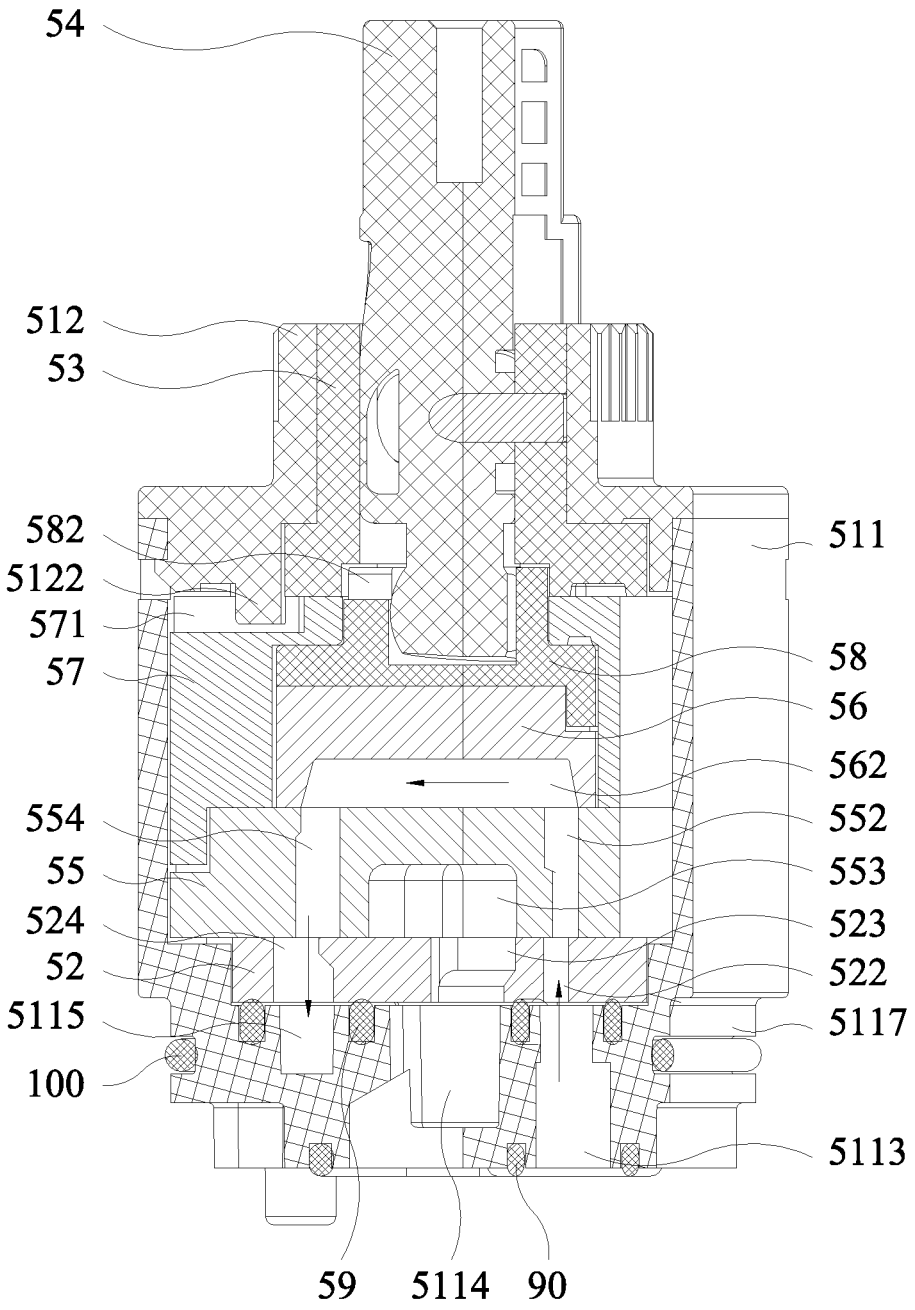
FIG. 16 is a second schematic view according to the embodiment of the present invention, wherein the lever swings to be in the closed state.

As shown in FIG. 15 and FIG. 16, when the lever 54 swings to be in the closed state, the lever 54 drives the whole movable plate unit to move, so that the relative position of the first movable plate 55 and the immovable plate 52 is changed. The fourth perforations 552, the second groove 562 and the fifth perforation 554 are in communication with the third perforation 524, so that water flows out from the second outlet 5115, not from the first outlet 5114. That is, the sensor-operated water discharge device is in the sensor-operated mode, which is controlled by the solenoid valve 7. At this time, when the lever 54 is rotated to the center position, the area of the two fourth perforations 552 blocked by the stop blocks 563 is the same. Hot water and cold water is mixed in a ratio of 1:1. After the lever 54 is rotated again, the second movable plate 56 is driven to rotate by the bracket 53 to adjust the relative position of the second movable plate 56 and the first movable plate 55, thereby changing the cross-sectional areas of the two fourth perforations 552 to be opened for discharging water, that is, to adjust the mixing ratio of cold water and hot water of the sensor-operated mode.

Figure 17:
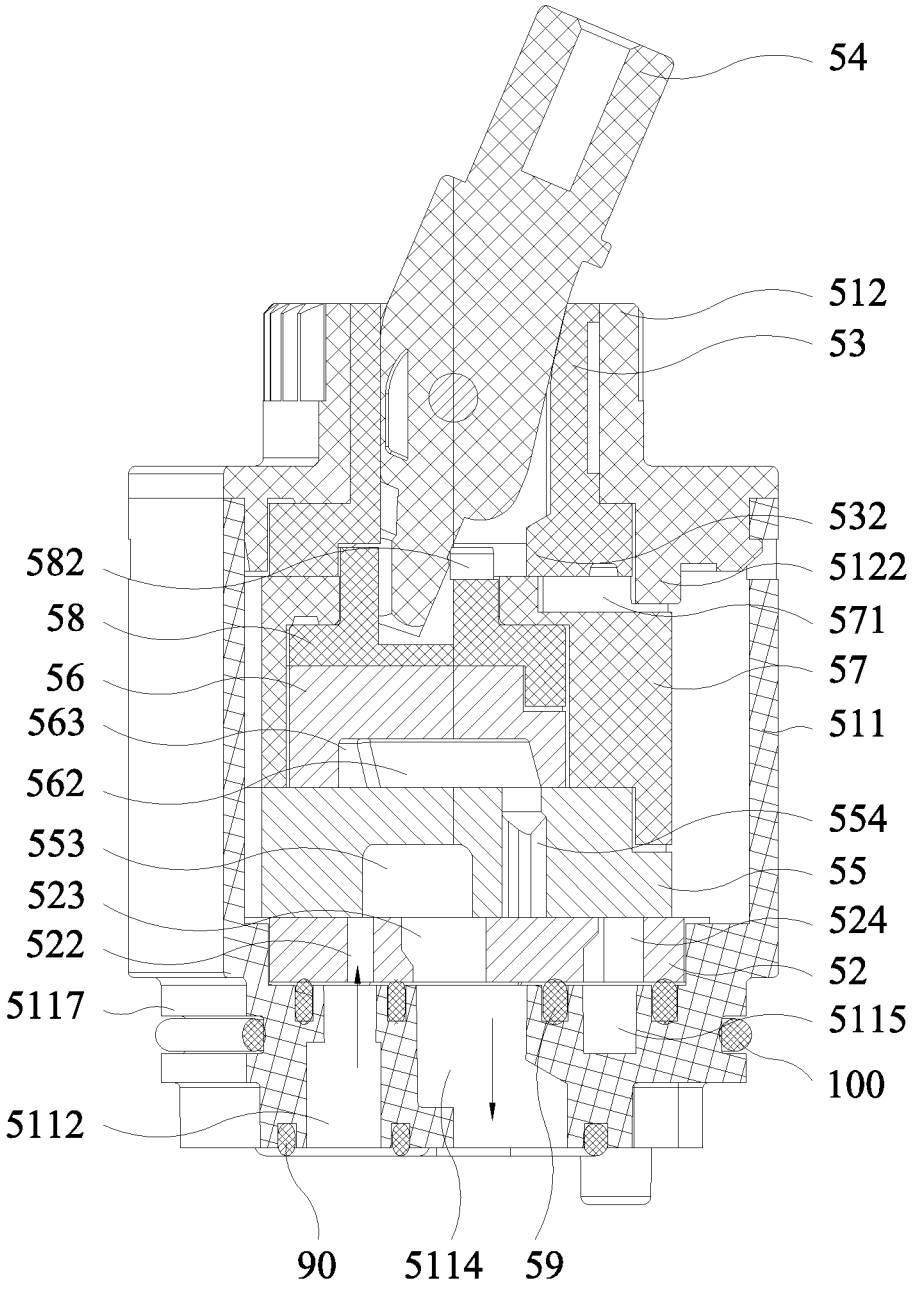
FIG. 17 is a first schematic view according to the embodiment of the present invention, wherein the lever swings to be in the open state to discharge the mixed water of cold water and hot water.
Figure 18:
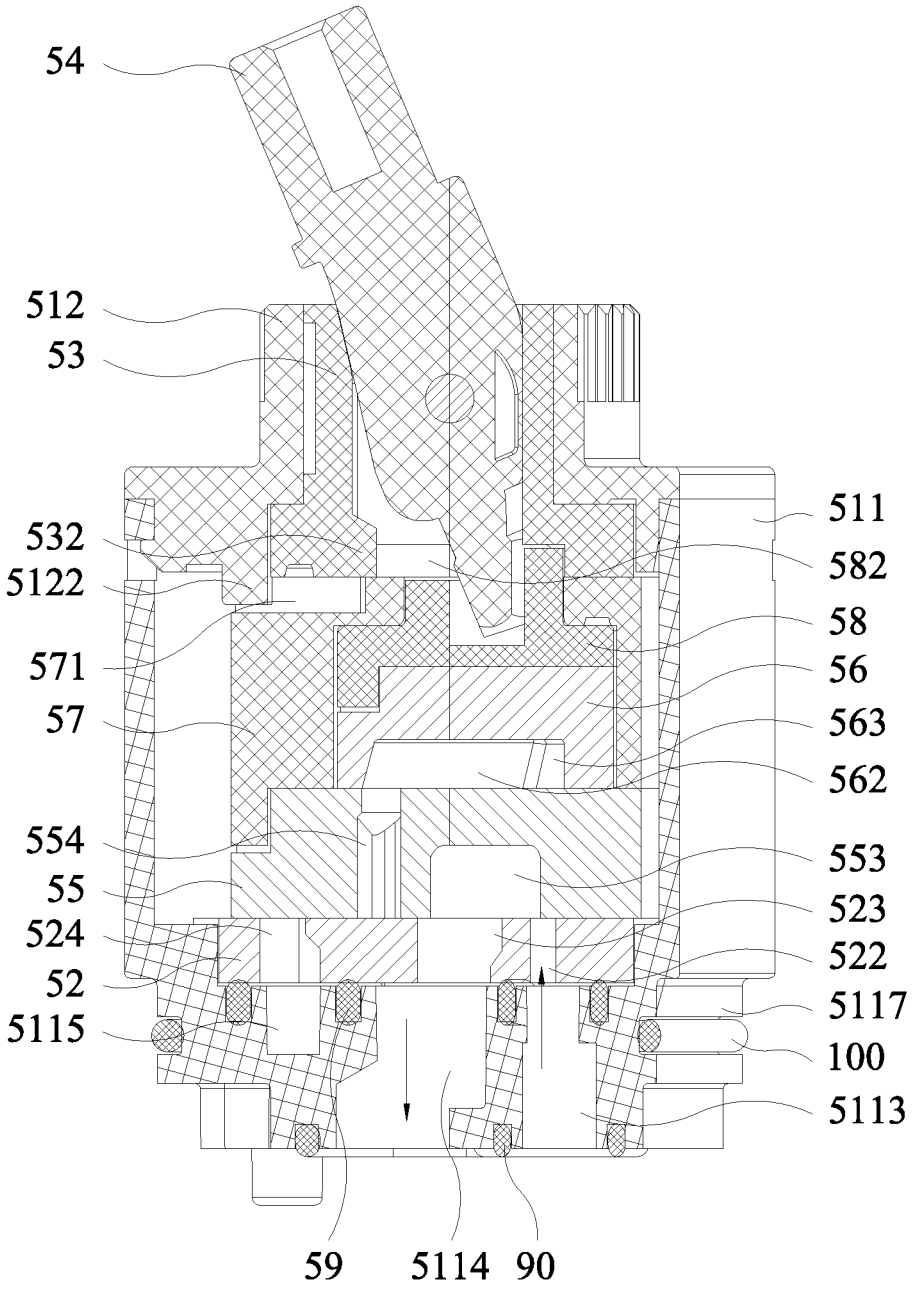
FIG. 18 is a second schematic view according to the embodiment of the present invention, wherein the lever swings to be in the open state to discharge the mixed water of cold water and hot water.
Figure 19:
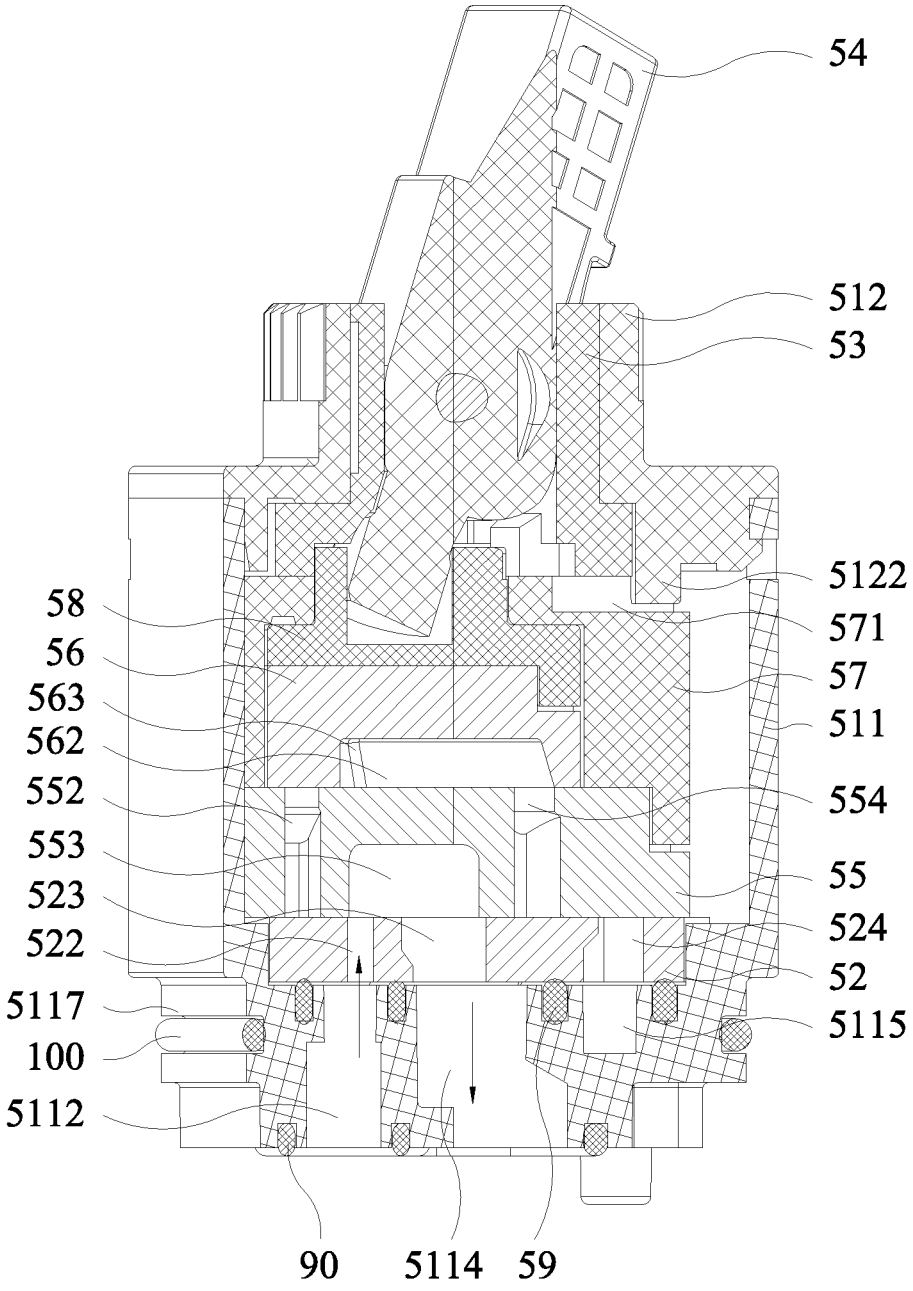
FIG. 19 is a schematic view according to the embodiment of the present invention, wherein the lever swings to be in the open state to discharge cold water.
Figure 20:
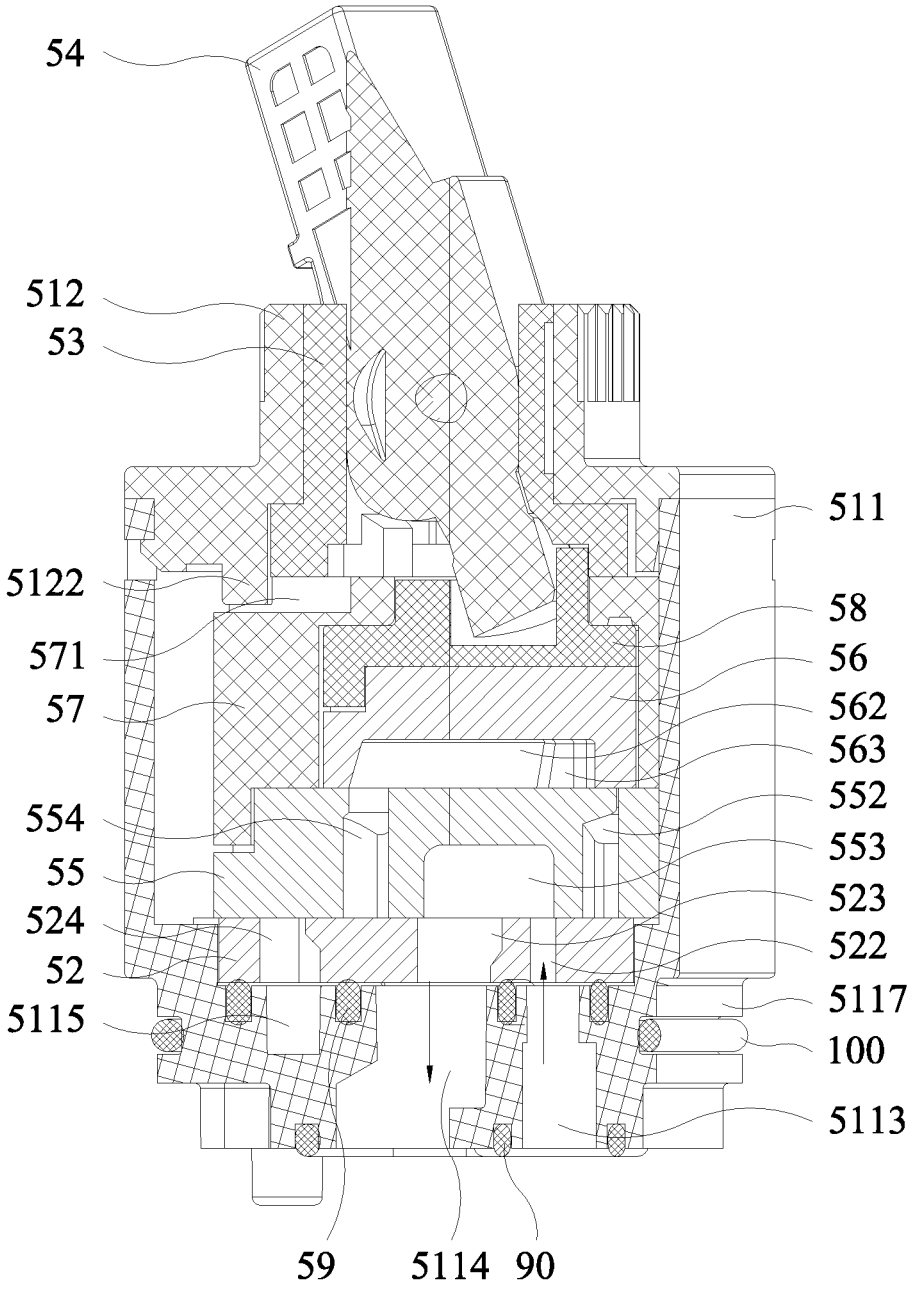
FIG. 20 is a schematic view according to the embodiment of the present invention, wherein the lever swings to be in the open state to discharge hot water.

As shown in FIG. 17 and FIG. 18, when the lever 54 swings to be in the open state and is in the middle position, the lever 54 drives the whole movable plate unit to move, so that the relative position of the first movable plate 55 and the immovable plate 52 is changed. The first groove 553 is in communication with the first perforations 522 and the second perforation 523, so that water flows out from the first outlet 5114, not from the second outlet 5115. That is, the sensor-operated water discharge device is in the mechanically-operated mode, which is controlled by the lever 54 (namely, the handle 6). At this time, since the lever 54 is in the middle position, cold water and hot water are mixed in a ratio of 1:1. As shown in FIG. 19, when the lever 54 swings to be the open state and rotates to the extremity of one side, the first perforation 522 corresponding to the first inlet 5112 is completely opened, and the other first perforation 522 corresponding to the second inlet 5113 is fully closed, so that all the water to be discharged is cold water. As shown in FIG. 20, when the lever 54 swings to be in the open state and rotates to the extremity of the other side, the first perforation 522 corresponding to the first inlet 5112 is completely closed, and the other first perforation 522 corresponding to the second inlet 5113 is fully opened, so that the water to be discharged is hot water.

What is claimed is:

1. A water discharge structure, comprising a valve core seat;

a surface of the valve core seat having a cold water inlet, a cold water outlet, a hot water inlet, a hot water outlet, a sensor-operated mixed water inlet, a first accommodating chamber, a main water outlet and a mechanically-operated mixed water inlet, the cold water outlet, the hot water outlet, the sensor-operated mixed water inlet and the mechanically-operated mixed water inlet being located on a same end face of the valve core seat; a first flow channel and a second flow channel being defined inside the valve core seat;

the cold water inlet being in communication with the cold water outlet;

the hot water inlet being in communication with the hot water outlet;

the sensor-operated mixed water inlet being in communication with the first accommodating chamber via the first flow channel;

the first accommodating chamber being in communication with the main water outlet via the second flow channel and being configured to accommodate a solenoid valve that controls opening and closing of the first flow channel and the second flow channel;

the mechanically-operated mixed water inlet being in communication with the main water outlet;

the valve core seat has a receiving channel passing through the valve core seat and extending vertically for receiving a water outlet tube of a sensor-operated water discharge device; the first flow channel and the second flow channel are disposed beside the receiving channel.

2. The water discharge structure as claimed in claim 1, wherein a fifth flow channel is defined inside the valve core seat, the fifth flow channel is arranged in parallel with the receiving channel, the second flow channel, the main water outlet and the mechanically-operated mixed water inlet are all in communication with the fifth flow channel; the cold water inlet, the hot water inlet and the main water outlet are all disposed on a lower surface of the valve core seat.

3. The water discharge structure as claimed in claim 1, further comprising a first plug, a second plug, a third plug and a plurality of sealing rings that are tightly fitted with the valve core seat; the first flow channel having an open outlet end that is blocked by the first plug and a corresponding one of the sealing rings; the second flow channel having an open inlet end that is blocked by the second plug and a corresponding one of the sealing rings; the second flow channel further having an open upper surface that is blocked by the third plug and a corresponding one of the sealing rings.

4. A sensor-operated water discharge device, comprising a water discharge structure, a valve core, a handle, a solenoid valve, a cold water inlet tube, a hot water inlet tube, and a water outlet tube;

the water discharge structure comprising a valve core seat; a surface of the valve core seat having a cold water inlet, a cold water outlet, a hot water inlet, a hot water outlet, a sensor-operated mixed water inlet, a first accommodating chamber, a main water outlet and a mechanically-operated mixed water inlet, the cold water outlet, the hot water outlet, the sensor-operated mixed water inlet and the mechanically-operated mixed water inlet being located on a same end face of the valve core seat; a first flow channel and a second flow channel being defined inside the valve core seat; the cold water inlet being in communication with the cold water outlet; the hot water inlet being in communication with the hot water outlet; the sensor-operated mixed water inlet being in communication with the first accommodating chamber via the first flow channel; the first accommodating chamber being in communication with the main water outlet via the second flow channel; the mechanically-operated mixed water inlet being in communication with the main water outlet;

one end of the valve core having a first inlet, a second inlet, a first outlet and a second outlet, the valve core being connected to the valve core seat, the first inlet being in communication with the cold water outlet, the second inlet being in communication with the hot water outlet, the first outlet being in communication with the mechanically-operated mixed water inlet, the second outlet being in communication with the sensor-operated mixed water inlet;

the handle being fitted on another end of the valve core and configured to switch opening and closing of the first inlet, the second inlet, the first outlet and the second outlet;

the solenoid valve being accommodated in the first accommodating chamber for controlling opening and closing of the first flow channel and the second flow channel;

the cold water inlet tube being connected to the cold water inlet;

the hot water inlet tube being connected to the hot water inlet;

the water outlet tube being connected to the main water outlet;

the sensor-operated water discharge device further comprises a faucet body, a valve core cap, a faucet spout, and a spray head; the water discharge structure and the valve core being installed in the faucet body and restricted by the valve core cap; one end of the faucet spout being connected to the faucet body; the spray head being installed at another end of the faucet spout, the water outlet tube being in communication with the spray head;

the sensor-operated water discharge device further comprises a pull-out hose, the valve core seat having a receiving channel passing through the valve core seat and extending vertically, the pull-out hose being movably inserted through the receiving channel of the valve core seat, an outlet end of the water outlet tube being in communication with an inlet end of the pull-out hose, an outlet end of the pull-out hose being in communication with the spray head.

5. The sensor-operated water discharge device as claimed in claim 4, further comprising a sensor, the faucet body having a sensor window, the sensor being installed in the sensor window and electrically connected to the solenoid valve.

6. The sensor-operated water discharge device as claimed in claim 4, further comprising a first sealing member between the valve core seat and the valve core, respective communication relationships between the first inlet and the cold water outlet, between the second inlet and the hot water outlet, between the first outlet and the mechanically-operated mixed water inlet and between the second outlet and the sensor-operated mixed water inlet being independent of each other.

7. The sensor-operated water discharge device as claimed in claim 4, wherein the valve core comprises a casing, an immovable plate, a movable plate unit, a bracket, and a lever; the cashing has a second accommodating chamber, one end of the second accommodating chamber has the first inlet, the second inlet, the first outlet, and the second outlet; the immovable plate, the movable plate unit and the bracket are sequentially fitted in the second accommodating chamber in a direction from one end to another end of the second accommodating chamber;

the movable plate unit includes a first movable plate, a second movable plate, a first dial and a second dial; the first movable plate and the first dial are coaxially connected, the second movable plate and the second dial are coaxially connected and movably fitted between the first movable plate and the first dial; a first restricting mechanism is disposed between the first dial and the casing, a second restricting mechanism is disposed between the second dial and the bracket;

a middle portion of the lever is coaxially connected to the bracket so that the lever can swing relative to the bracket, one end of the lever is connected to the movable plate unit, another end of the lever is connected to the handle;

wherein when the lever swings to be in an open state, the first restricting mechanism and the second restricting mechanism are in an unlocked state, the first inlet and the second inlet are in communication with the first outlet and are not in communication with the second outlet, and the lever is rotated to adjust a relative position of the first movable plate and the immovable plate, so as to adjust a water mixing ratio of the first inlet, the second inlet and the first outlet;

wherein when the lever swings to be in a closed state, the first restricting mechanism and the second restricting mechanism are in a locked state, the first inlet and the second inlet are in communication with the second outlet and are not in communication with the first outlet, and the lever is rotated to adjust a relative angle between the second movable plate and the first movable plate, so as to adjust a water mixing ratio of the first inlet, the second inlet and the second outlet.

8. The sensor-operated water discharge device as claimed in claim 7, wherein the casing includes a valve core body and a cover; the valve core body has the second accommodating chamber; one end of the valve core body has the first inlet, the second inlet, the first outlet, and the second outlet; the cover is connected to another end of the valve core body in a snap-fit manner, the cover has a mounting hole for insertion of the bracket; the immovable plate, the first movable plate and the second movable plate are ceramic plates.

9. The sensor-operated water discharge device as claimed in claim 7, wherein the first restricting mechanism includes a protruding post disposed in the second accommodating chamber and a guide groove disposed on a surface of the first dial, the guide groove is arranged along a radial direction of the first dial; the protruding post is movable between two ends of the guide groove when the lever swings; when the lever swings to be in the open state, the protruding post is located at the outer end of the guide groove, and the lever is rotated for the movable plate unit to swing along a radial direction of the casing with the protruding post as a fulcrum, so as to adjust the relative position of the first movable plate and the immovable plate.

10. The sensor-operated water discharge device as claimed in claim 9, wherein a first protruding block is disposed in the second accommodating chamber, the protruding post is disposed on the first protruding block; the bracket has a first notch; the first protruding block is movably fitted in the first notch along with rotation of the bracket, and the protruding post passes through the first notch and is fitted in the guide groove.

11. The sensor-operated water discharge device as claimed in claim 7, wherein the first dial has a receiving chamber therein, the second movable plate and the second dial are movably fitted in the receiving chamber, the first dial further has an opening communicating with the receiving chamber; the second dial has a boss matching with the opening, the boss passes through the opening; the second restricting mechanism includes a second protruding block disposed on the bracket and a second notch formed on the boss, an arc length of the second notch is greater than a width of the second protruding block; when the lever swings to be in the open state, the second protruding block is separated from a circumferential path of the second notch; when the lever swings to be in the closed state, the second protruding block is located in the second notch, and the lever drives the bracket to rotate synchronously, so that the second protruding block abuts against one end of the second notch to drive the second dial and the second movable plate to rotate relative to the first movable plate.

12. The sensor-operated water discharge device as claimed in claim 11, wherein the one end of the lever is a ball joint, the second dial has a receiving groove, the ball joint is movably fitted in the receiving groove, and the second notch is disposed on a side wall of one end of the receiving groove.

13. The sensor-operated water discharge device as claimed in claim 7, wherein an edge of the immovable plate has a first restricting notch, a first restricting block is disposed on a side wall of the second accommodating chamber, the first restricting block is engaged in the first restricting notch; edges of mating surfaces of the first dial and the first movable plate have a second restricting block and a second restricting notch, the second restricting block is engaged in the second restricting notch; edges of mating surfaces of the second dial and the second movable plate have a third restricting block and a third restricting notch, and the third restricting block is engaged in the third restricting notch.

14. The sensor-operated water discharge device as claimed in claim 7, wherein the immovable plate further has two first perforations, a second perforation and a third perforation, the two first perforations are in communication with the first inlet and the second inlet respectively, the second perforation is in communication with the first outlet, the third perforation is in communication with the second outlet; the first movable plate further has two fourth perforations, a first groove and a fifth perforation, the two fourth perforations are aligned with the two first perforations respectively, when the first movable plate is moved relative to the immovable plate, the first groove is in communication with the first perforations and the second perforation, or the fifth perforation is in communication with the third perforation; the second movable plate further has a second groove and two stop blocks in the second groove, the fourth perforations and the fifth perforation are in communication with the second groove; and the stop blocks are configured to block the corresponding fourth perforations for changing water flow when the second movable plate is rotated relative to the first movable plate.

15. The sensor-operated water discharge device as claimed in claim 14, further comprising a second sealing member disposed between an end wall of the second accommodating chamber and the immovable plate; the second sealing member having a first through hole, a second through hole and a third through hole corresponding to the first perforations, the second perforation and the third perforation, respectively.

16. The sensor-operated water discharge device as claimed in claim 7, wherein the first outlet is disposed at a middle position of one end of the casing, the first inlet, the second inlet and the second outlet are disposed beside the first outlet, the second outlet includes at least one second outlet; an annular step is formed on a peripheral surface of the one end of the casing, a sealing ring is sleeved on the step, the end face of the valve core seat, having the cold water outlet, is a recessed end face and is fitted on the step, and the sealing ring is configured to seal a junction of the valve core and the valve core seat.

* * * * *